United States Patent [19]

Takasu et al.

[11] 4,454,211

[45] Jun. 12, 1984

[54] ELECTROPHOTOGRAPHIC PHOTOSENSITIVE MEMBER WITH PYRAZOLINE CHARGE TRANSPORT MATERIAL

[75] Inventors: Yoshio Takasu, Tama; Shozo Ishikawa, Sayama, both of Japan

[73] Assignees: Canon Kabushiki Kaisha; Copyer Kabushiki Kaisha, both of Tokyo, Japan

[21] Appl. No.: 383,629

[22] Filed: Jun. 1, 1982

[30] Foreign Application Priority Data

| | | | |
|---|---|---|---|
| Jun. 10, 1981 | [JP] | Japan | 56-89256 |
| Jun. 15, 1981 | [JP] | Japan | 56-91876 |
| Jun. 23, 1981 | [JP] | Japan | 56-97764 |
| Jun. 23, 1981 | [JP] | Japan | 56-97765 |
| Jun. 23, 1981 | [JP] | Japan | 56-97766 |
| Jun. 23, 1981 | [JP] | Japan | 56-97767 |
| Jun. 23, 1981 | [JP] | Japan | 56-97768 |
| Jul. 22, 1981 | [JP] | Japan | 56-114837 |
| Jul. 22, 1981 | [JP] | Japan | 56-114838 |

[51] Int. Cl.[3] ..... G03G 5/06; G03G 5/14

[52] U.S. Cl. ..... 430/59; 430/58; 430/76; 430/77; 430/78; 548/374; 548/379

[58] Field of Search ..... 430/58, 59, 76, 77, 430/78

[56] References Cited

U.S. PATENT DOCUMENTS

| | | | |
|---|---|---|---|
| 3,180,729 | 4/1965 | Klupfel et al. . | |
| 3,837,851 | 9/1974 | Shattuck et al. . | |
| 3,859,303 | 1/1975 | Katsuyama et al. | 430/76 X |
| 4,278,746 | 7/1981 | Goto et al. . | |
| 4,315,982 | 2/1982 | Ishikawa et al. . | |

FOREIGN PATENT DOCUMENTS

| | | | |
|---|---|---|---|
| 55-2285 | 1/1980 | Japan | 430/58 |
| 55-88065 | 7/1980 | Japan | 430/59 |
| 1030024 | 5/1966 | United Kingdom . | |

*Primary Examiner*—Roland E. Martin, Jr.
*Attorney, Agent, or Firm*—Fitzpatrick, Cella, Harper & Scinto

[57] ABSTRACT

An electrophotographic photosensitive member is characterized by comprising a layer which contains at least one pyrazoline compound represented by the following formula (I) or (II):

Formula (I)

wherein m and n represent 0 or 1;

when both m and n are 0, $X_1$ represents a substituted or unsubstituted heterocyclic residue; $R_1$ represents a substituted or unsubstituted aryl or heterocyclic residue; $R_2$ and $R_3$ each represent hydrogen or a substituted or unsubstituted aryl or heterocyclic residue; or they form spiropyrazoline cojointly with the carbon atom to which they are linked; and $R_5$ represents hydrogen, a halogen, or a substituted or unsubstituted alkyl or aryl;

when m is 1 and n is 0, $X_1$ represents a substituted or unsubstituted heterocyclic residue; $R_1$ and $R_2$ each represent a substituted or unsubstituted aryl or heterocyclic residue; $R_3$ represents hydrogen; and $R_4$ and $R_5$ each represent hydrogen, a halogen, or a substituted or unsubstituted alkyl or aryl;

when m is 0 and n is 1, $X_1$, $R_1$, $R_2$, and $R_3$ each represent a substituted or unsubstituted aryl or heterocyclic residue, $R_2$ and $R_3$ may also form spiropyrazoline cojointly with the carbon atom to which they are linked, and one of $R_2$ and $R_3$ can also be hydrogen but $X_1$ is not a substituted or unsubstituted aryl unless $R_2$ and $R_3$ form spiropyrazoline as mentioned above; and $R_4$ and $R_5$ each represent hydrogen, a halogen, or a substituted or unsubstituted alkyl or aryl; if $R_3$, $R_4$, and $R_5$ each are hydrogen, neither $R_1$ nor $R_2$ is a di-substituted aminophenyl;

when both m and n are 1, $X_1$ represents a substituted or unsubstituted heterocyclic residue; $R_1$ and $R_2$ each represent a substituted or unsubstituted aryl or heterocyclic residue; and $R_4$ and $R_5$ each represent hydrogen, a halogen, or a substituted or unsubstituted alkyl or aryl.

Formula (II)

wherein $X_2$ and $X_3$ each represent a substituted or unsubstituted heterocyclic residue; $R_6$ represents a substituted or unsubstituted divalent hydrocarbon residue; $R_7$ and $R_8$ each represent a substituted or unsubstituted aryl or heterocyclic residue; and $R_9$ and $R_{10}$ each represent hydrogen, a halogen, or a substituted or unsubstituted alkyl or aryl.

9 Claims, No Drawings

ELECTROPHOTOGRAPHIC PHOTOSENSITIVE MEMBER WITH PYRAZOLINE CHARGE TRANSPORT MATERIAL

BACKGROUND OF THE INVENTION

1. Field of the Invention

This invention relates to an improved electrophotographic photosensitive member and more particularly to an electrophotographic photosensitive member containing a pyrazoline compound suitable as a charge-transporting material, the photosensitive member comprising a charge generation layer and a charge transport layer.

2. Description of the Prior Art

There have so far been known inorganic photoconductive materials such as selenium, cadmium sulfide, zinc oxide, etc. as photoconductive materials used for electrophotographic photosensitive members. In contrast to their many advantages, for instance, chargeability to a suitable potential in a dark place, slight dissipation in a dark place, and capability of dissipating rapidly charge by light irradiation, these photoconductive materials have various disadvantages, for example, as follows: in the case of selenium type photosensitive members, the crystallization of the photoconductive materials readily proceeds under the influence of surrounding factors such as temperature, moisture, dust, and pressure, in particular remarkably when the surrounding temperature exceeds 40° C., thus resulting in lowering of chargeability or white spots in image. In the cases of these photosensitive members and cadmium sulfide type photosensitive members, stable sensitivity and durability cannot be obtained in repeated operations under high humidity conditions. In the case of zinc oxide type photosensitive members, which require sensitization by a sensitizing pigment, Rose Bengal being a typical sensitizing pigment, stable images cannot be obtained over a long period of time, since the sensitizing pigment tends to cause charge deterioration by corona discharge and light fading by exposure to light.

On the other hand, various kinds of organic photoconductive polymers have been proposed the first of which was polyvinylcarbazole. However, although excellent in film forming properly, in lightness, and in some other points as compared with said inorganic photoconductive materials, these polymers have until now failed to be put to practical use, by reason that they are still unsatisfactory in film forming property and inferior to the inorganic photoconductive materials in sensitivity, durability, and stability to change of environmental conditions.

Such being the case, in recent years laminated members have offered which comprise two layers provided with separate functions, that is, a charge generation layer and a charge transport layer which contains an organic photoconductive materials. Electrophotographic photosensitive members comprising such photoconductive layers of laminate structure have been improved in certain points such as sensitivity to visible light, charge bearing capacity, and surface strength, in which photosensitive members employing organic photoconductive materials had been deficient. Such improved electrophotographic photosensitive members have been disclosed, for example, in U.S. Pat. No. 3,837,851 (Japanese Pat. Appl. Laid-open No. 105537/1974), U.K. Pat. No. 1,453,024 (Japanese Pat. Appl. Laid-open No. 90827/1976), and U.S. Pat. Nos. 3,484,237 and 3,871,882.

Electrophotographic photosensitive members employing existing organic photoconductive materials are however still unsatisfactory in sensitivity and disadvantageous in that notable variations of surface potential are caused by repeated charging and exposure, and in particular an increase in light area potential and a decrease in dark area potential are remarkable in that case.

SUMMARY OF THE INVENTION

An object of this invention is to provide a novel electrophotographic photosensitive member for eliminating such defects or disadvantages as mentioned above.

Another object of this invention is to provide a novel organic photoconductive material.

A still another object of this invention is to provide a novel pyrazoline compound suitable for use as a charge-transporting material in the above-mentioned photosensitive layers of laminate structure.

A further object of this invention is to provide a photosensitive layer comprising a charge generation layer and a charge transporting layer containing a novel charge-transporting material.

A further object of this invention is to provide an electrophotographic photosensitive member improved in sensitivity and durability.

These objects of this invention can be achieved with an electrophotographic photosensitive member comprising a layer which contains at least one pyrazoline compound represented by the following formula (I) or (II):

Formula (I)

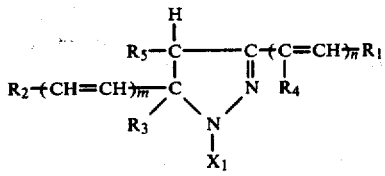

wherein m and n each represent 0 or 1;

when both m and n are 0, $X_1$ represents a substituted or unsubstituted heterocyclic residue;

$R_1$ represents a substituted or unsubstituted aryl or heterocyclic residue;

$R_2$ and $R_3$ each represent hydrogen or a substituted or unsubstituted aryl or heterocyclic residue, or they form spiropyrazoline cojointly with the carbon atom to which they are linked; and $R_5$ represents hydrogen, a halogen, or a substituted or unsubstituted alkyl or aryl;

when m is 1 and n is 0;

$X_1$ represents a substituted or unsubstituted heterocyclic residue;

$R_1$ and $R_2$ each represent a substituted or unsubstituted aryl or heterocyclic residue;

$R_3$ represents hydrogen; and $R_4$ and $R_5$ each represent hydrogen, a halogen, or a substituted or unsubstituted alkyl or aryl;

when m is 0 and n is 1, $X_1$, $R_1$, $R_2$ and $R_3$ each represent a substituted or unsubstituted aryl or heterocyclic residue, $R_2$ and $R_3$ may also form spiropyrazoline cojointly with the carbon atom to which they are linked, and one of $R_2$ and $R_3$ can also be hydrogen, but $X_1$ is not a substituted or unsubstituted aryl unless $R_2$ and $R_3$ form spiropyrazoline as mentioned above;

$R_4$ and $R_5$ each represent hydrogen, a halogen, or a substituted or unsubstituted alkyl or aryl; and if $R_3$, $R_4$, and $R_5$ are hydrogen, neither $R_1$ nor $R_2$ is a di-substituted aminophenyl;

when both m and n are 1, $X_1$ represents a substituted or unsubstituted heterocyclic residue;

$R_1$ and $R_2$ each represent a substituted or unsubstituted aryl or heterocyclic residue; and $R_4$ and $R_5$ each represent hydrogen, a halogen, or a substituted or unsubstituted alkyl or aryl.

Formula (II)

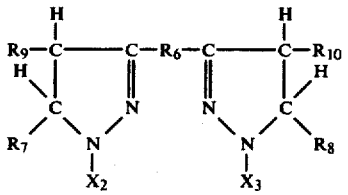

wherein $X_2$ and $X_3$ each represent a substituted or unsubstituted heterocyclic resudue;

$R_6$ represents a substituted or unsubstituted divalent hydrocarbon residue;

$R_7$ and $R_8$ each represent a substituted or unsubstituted aryl or heterocyclic residue; and $R_9$ and $R_{10}$ each represent hydrogen, a halogen, or a substituted or unsubstituted alkyl or aryl.

DETAILED DESCRIPTION OF THE PREFRRED EMBODIMENT

The organic photoconductive materials or charge-transporting for use in this invention are represented by the following formula (I) or (II):

Formula (I)

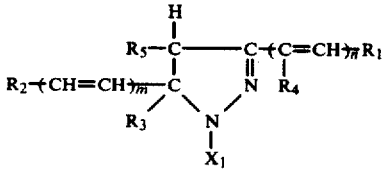

wherein m and n represent 0 or 1;

when both m and n are 0, $X_1$ represents a substituted or unsubstituted heterocyclic residue;

$R_1$ represents a substituted or unsubstituted aryl or heterocyclic residue;

$R_2$ and $R_3$ each represent hydrogen or a substituted or unsubstituted aryl or heterocyclic residue; or they form spiropyrazoline cojointly with the carbon atom to which they are linked; and $R_5$ represents hydrogen, a halogen, or a substituted or unsubstituted alkyl or aryl;

when m is 1 and n is 0, $X_1$ represents a substituted or unsubstituted heterocyclic residue;

$R_1$ and $R_2$ each represent a substituted or unsubstituted aryl or heterocyclic residue;

$R_3$ represents hydrogen; and $R_4$ and $R_5$ each represent hydrogen, a halogen, or a substituted or unsubstituted alkyl or aryl;

when m is 0 and n is 1, $X_1$, $R_1$, $R_2$ and $R_3$ each represent a substituted or unsubstituted aryl or heterocyclic residue, $R_2$ and $R_3$ may also form spiropyrazoline cojointly with the carbon atom to which they are linked, and one of $R_2$ and $R_3$ can also be hydrogen, but $X_1$ is not a substituted or unsubstituted aryl unless $R_2$ and $R_3$ form spiropyrazoline as mentioned above;

$R_4$ and $R_5$ each represent hydrogen, a halogen, or a substituted or unsubstituted alkyl or aryl; and if $R_3$, $R_4$, and $R_5$ are hydrogen, neither $R_1$ nor $R_2$ is a di-substituted aminophenyl;

when both m and n are 1, $X_1$ represents a substituted or unsubstituted heterocyclic residue;

$R_1$ and $R_2$ each represent a substituted or unsubstituted aryl or heterocyclic residue; and $R_4$ and $R_5$ each represent hydrogen, a halogen, or a substituted or unsubstituted alkyl or aryl.

Formula (II)

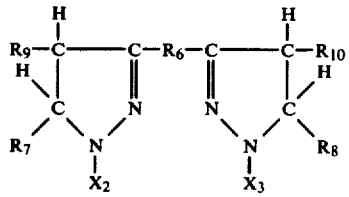

wherein $X_2$ and $X_3$ each represent a substituted or unsubstituted heterocyclic residue;

$R_6$ represents a substituted or unsubstituted divalent hydrocarbon residue;

$R_7$ and $R_8$ each represent a substituted or unsubstituted aryl or heterocyclic residue; and $R_9$ and $R_{10}$ each represent hydrogen, a halogen, or a substituted or unsubstituted alkyl or aryl.

The heterocyclic residue represented by $X_1$, $X_2$, $X_3$, $R_1$, $R_2$, $R_3$, $R_7$, or $R_8$ is selected from 2-pyridyl, 3-pyridyl, 4-pyridyl, 2-quinolyl, 4-quinolyl, 3-carbazolyl, 2-furyl, 4-imidazolyl, 4-oxazolyl, 4-thiazolyl, isoxazolyl, and the like. These heterocyclic residues may also have substituents selected from halogens (e.g., chlorine and bromine), alkyls (e.g., methyl, ethyl, n-propyl, isopropyl, n-butyl, t-butyl, etc.), alkoxys (e.g., methoxy, ethoxy, butoxy, etc.), substituted alkyls (e.g., benzyl, 2-phenylethyl, α-naphthylmethyl, β-naphthylmethyl, 2-methoxyethyl, 3-methoxypropyl, 2-hydroxyethyl, 3-hydroxypropyl, 3-carboxypropyl, 2-chloroethyl, 2-bromoethyl, etc.), and aryls (e.g. phenyl, tolyl, xylyl, α-naphthyl, β-naphthyl, etc.).

The aryl or substituted aryl as $X_1$ is selected from phenyl, tolyl, xylyl, biphenyl, chlorophenyl, dichlorophenyl, trichlorophenyl, bromophenyl, dibromophenyl, tribromophenyl, cyanophenyl, ethylphenyl, methoxyphenyl, α-naphthyl, β-naphthyl, etc.

The aryl as $R_1$, $R_2$, $R_3$, $R_7$, or $R_8$ is selected from phenyl, α-naphthyl, β-naphthyl, anthryl, etc. These aryls are preferred to have substituents selected from dialkylaminos (e.g., N,N-dimethylamino, N,N-diethylamino, N,N-dipropylamino, N,N-dibutylamino, N,N-dipentylamino, N-methyl-N-ethylamino, N-methyl-N-propylamino, and N-ethyl-N-propylamino), cyclic aminos (e.g., morpholino, piperidino, and pyrrolidino), and alkoxys (e.g., methoxy, ethoxy, propoxy, and butoxy). Further, alkyls of the above dialkylamino and of the above alkoxy each may also be substituted by a suitable atom (e.g., chlorine, bromine, or fluorine) or an organic residue (e.g., tolyl, xylyl, chlorophenyl, phenyl, naphthyl, hydroxy, carboxy, cyano, or amino). Typical examples of the aryl include dialkylaminophenyl, cyclic aminophenyl, and alkoxyphenyl, for example, 4-N-N-dimethylaminophenyl, 4-N,N-diethylaminophenyl, 4-N,N-dipropylaminophenyl, 4-N,N-dibutylaminophenyl, 4-N,N-dibenzylaminophenyl, 4-morpholinophenyl, 4-piperidinophenyl, 4-pyrrolidinophenyl, 4-methoxyphenyl, 4-ethoxyphenyl, 4-butoxyphenyl, etc.

The aryl or substituted aryl as $R_4$, $R_5$, $R_9$, or $R_{10}$ is selected from phenyl, tolyl, xylyl, biphenyl, ethylphenyl, diethylphenyl, nitrophenyl, cyanophenyl, hydroxyphenyl, carboxyphenyl, chlorophenyl, dichlorophenyl, trichlorophenyl, bromophenyl, dibromophenyl, aminophenyl, N-N-dimethylaminophenyl, N,N-diethylaminophenyl, N-N-dibenzylaminophenyl, α-naphthyl, β-naphthyl, etc.

The halogen atom represented by $R_4$, $R_5$, $R_9$, or $R_{10}$ is selected from chlorine, bromine, iodine atoms, and the like, and alkyl or substituted alkyl represented by the same is selected from $C_1$–$C_5$ alkyls such as, for example, methyl, ethyl, n-propyl, isopropyl, n-butyl, t-butyl, n-amyl, and t-amyl or from substituted alkyls such as, for example, benzyl, chlorobenbenzyl, dichlorobenzyl, trichlorobenzyl, bromobenzyl, methylbenzyl, dimethylbenzyl, cyanobenzyl, 2-phenylethyl, α-naphthylmethyl, β-naphthylmethyl, vinylmethyl, 2-chloroethyl, 3-chloropropyl, 2-hydroxyethyl, 3-hydroxypropyl, 2-methoxyethyl, 3-methoxypropyl, 4-methoxybutyl, and 2-phenoxyethyl.

As examples of the substituted or unsubstituted divalent hydrocarbon residue represented by $R_6$ in formula (II) above, there may be cited arylenes such as

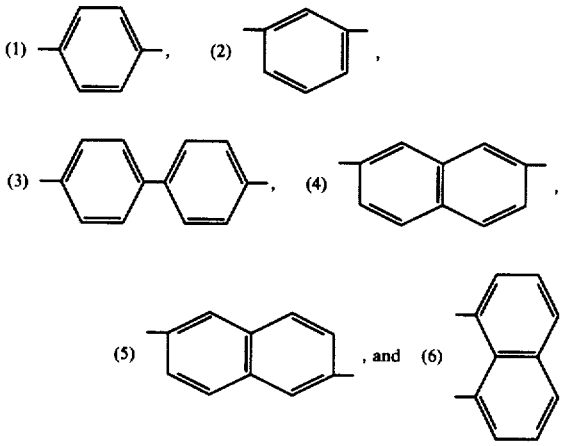

and aliphatic hydrocarbon residues such as (7) —CH=CH—, (8) —CH=CH—CH=CH—, (9) —$CH_2$—, and (10) —$CH_2$—$CH_2$—. These divalent residues each may be substituted by a suitable atom (e.g., chlorine, bromine, or fluorine, etc.) or an organic residue (e.g., cyano, hydroxy, carboxy, nitro, amino, methyl, ethyl, propyl, butyl, benzyl, 2-phenylethyl, 2-methoxyethyl, 3-methoxypropyl, 2-hydroxyethyl, phenyl, tolyl, etc.).

In preferred embodiments of this invention, the pyrazoline compound of formula (I) above is represented by the following formula of (1) to (8):

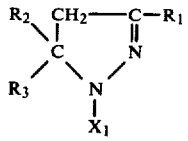
(1)

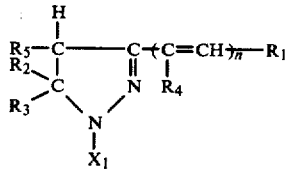
(2)

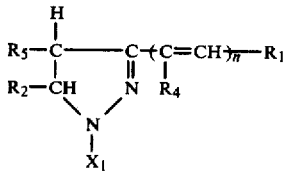
(3)

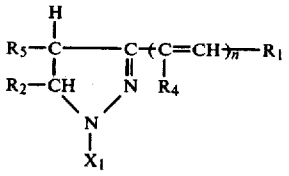
(4)

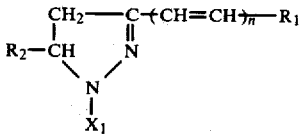
(5)

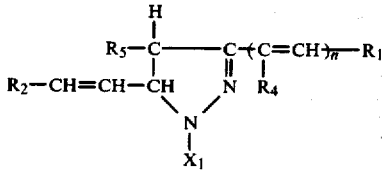
(6)

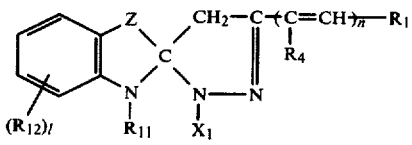
(7)

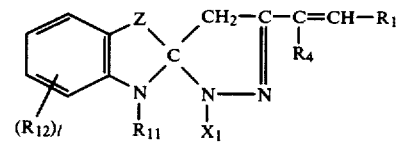
(8)

In these formulae, the same symbols as in formula (I) have the same meanings as given above; $R_{11}$ represents a substituted or unsubstituted alkyl (e.g., methyl, ethyl, propyl, 2-hydroxyethyl, and 2-chloroethyl); $R_{12}$ represents hydrogen, a halogen (e.g., chlorine, bromine, or iodine), or an organic monovalent residue, including, for example, alkyls (such as methyl, ethyl, and propyl), alkoxys (such as methoxy, ethoxy, and propoxy), alkoxycarbonyls (such as methoxycarbonyl, ethoxycarbonyl, and propoxycarbonyl), and nitro; l is an integer of 1 to 4; and Z represents

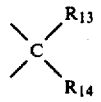

or —CH=CH—, wherein $R_{13}$ and $R_{14}$ each represent a substituted or unsubstituted alkyl such as methyl, ethyl, propyl, 2-hydroxyethyl, or 2-chloroethyl.

Examples of suitable pyrazoline compounds represented by formula (I) are listed below.

| Compound No. | Compound name |
|---|---|
| (1) | 1-[pyridyl-(3)]-3,5-di-(4-N,N—dimethylaminophenyl)-pyrazoline |
| (2) | 1-[pyridyl-(3)]-3,5-di-(4-N,N—diethylaminophenyl)-pyrazoline |
| (3) | 1-[pyridyl-(3)]-3,5-di-(4-N,N—dibenzylaminophenyl)-pyrazoline |
| (4) | 1-[pyridyl-(3)]-3,5-di-(4-N—ethyl-N—propylamino-phenyl)pyrazoline |
| (5) | 1-[pyridyl-(3)]-3-(4-N,N—diethylaminophenyl)-5-(4-N,N—dibenzylaminophenyl)pyrazoline |
| (6) | 1-[pyridyl-(3)]-3,5-di-(4-morpholinophenyl)-pyrazoline |
| (7) | 1-[pyridyl-(3)]-3,5-di-(4-piperidinophenyl)-pyrazoline |
| (8) | 1-[pyridyl-(3)]-3,5-di-(4-pyrrolidinophenyl)-pyrazoline |
| (9) | 1-[pyridyl-(3)]-3,5-di-(4-methoxyphenyl)pyrazoline |
| (10) | 1-[pyridyl-(3)]-3,5-di-(4-ethoxyphenyl)pyrazoline |
| (11) | 1-[pyridyl-(3)]-3-(4-N,N—diethylaminophenyl)-5-(4-methoxyphenyl)pyrazoline |
| (12) | 1-[pyridyl-(3)]-3,5-diphenylpyrazoline |
| (13) | 1-[pyridyl-(3)]-5,5-diphenyl-3-(4-N,N—diethyl-aminophenyl)pyrazoline |
| (14) | 1-[6-methoxy-pyridyl-(2)]-3,5-di-(4-N,N—dimethyl-aminophenyl)pyrazoline |
| (15) | 1-[6-methoxy-pyridyl-(2)]-3,5-di-(4-N,N—diethylaminophenyl)pyrazoline |
| (16) | 1-[6-methoxy-pyridyl-(2)]-3,5-di-(4-N,N—dibenzylaminophenyl)pyrazoline |
| (17) | 1-[6-methoxy-pyridyl-(2)]-3,5-di-(4-N,N—dipropylaminophenyl)pyrazoline |
| (18) | 1-[6-methoxy-pyridyl-(2)]-3,5-di-(4-N,N—dibuthylaminophenyl)pyrazoline |
| (19) | 1-[6-methoxy-pyridyl-(2)]-3-(4-N,N—diethyl-aminophenyl)-5-phenylpyrazoline |
| (20) | 1-[6-methoxy-pyridyl-(2)]-3-(4-N—ethyl-N—benzylaminophenyl)-5-(4-N,N—diethylaminophenyl)-pyrazoline |
| (21) | 1-[6-methoxy-pyridyl-(2)]-3,5-di-(4-methoxyphenyl)-pyrazoline |
| (22) | 1-[6-methoxy-pyridyl-(2)]-3-(4-N,N—diethyl-aminophenyl)-5-(4-methoxyphenyl)pyrazoline |
| (23) | 1-[6-methoxy-pyridyl-(2)]-3,5-di-(4-morpholino-phenyl)pyrazoline |
| (24) | 1-[6-methoxy-pyridyl-(2)]-3,5-di-(4-piperidino-phenyl)pyrazoline |
| (25) | 1-[6-methoxy-pyridyl-(2)]-3,5-di-(4-pyrrolidino-phenyl)pyrazoline |
| (26) | 1-[pyridyl-(2)]-3,5-di-(4-N,N—dimethylaminophenyl)-pyrazoline |
| (27) | 1-[pyridyl-(2)]-3,5-di-(4-N,N—diethylaminophenyl)-pyrazoline |
| (28) | 1-[pyridyl-(2)]-3,5-di-(4-N,N—dibenzylaminophenyl)-pyrazoline |
| (29) | 1-[pyridyl-(2)]-3,5-di-(4-N,N—dipropylamino-phenyl)pyrazoline |
| (30) | 1-[pyridyl-(2)]-3,5-di-(4-N,N—dibuthylamino-phenyl)pyrazoline |
| (31) | 1-[pyridyl-(2)]-3,5-di-(4-morpholinophenyl)-pyrazoline |
| (32) | 1-[pyridyl-(2)]-3,5-di-(4-methoxyphenyl)pyrazoline |
| (33) | 1-[pyridyl-(2)]-3-(4-N,N—diethylaminophenyl)-5-(4-methoxyphenyl)pyrazoline |
| (34) | 1-[quinolyl-(2)]-3,5-di-(4-N,N—dimethylamino-phenyl)pyrazoline |

-continued

| Compound No. | Compound name |
|---|---|
| (35) | 1-[quinolyl-(2)]-3,5-di-(4-N,N—diethylamino-phenyl)pyrazoline |
| (36) | 1-[quinolyl-(2)]-3,5-di-(4-N,N—dibenzylamino-phenyl)pyrazoline |
| (37) | 1-[quinolyl-(2)]-3,5-di-(4-N—ethyl-N—propylaminophenyl)pyrazoline |
| (38) | 1-[quinolyl-(2)]-3-(4-N,N—diethylaminophenyl)-5-(4-N,N—dibenzylaminophenyl)pyrazoline |
| (39) | 1-[quinolyl-(2)]-3,5-di-(4-morpholinophenyl) pyrazoline |
| (40) | 1-[quinolyl-(2)]-3,5-di-(4-piperidinophenyl)-pyrazoline |
| (41) | 1-[quinolyl-(2)]-3,5-di-(4-pyrrolidinophenyl)-pyrazoline |
| (42) | 1-[quinolyl-(2)]-3,5-di-(4-methoxyphenyl)-pyrazoline |
| (43) | 1-[quinolyl-(2)]-3,5-di-(4-ethoxyphenyl)pyrazoline |
| (44) | 1-[quinolyl-(2)]-3-(4-N,N—diethylaminophenyl)-5-(4-methoxyphenyl)pyrazoline |
| (45) | 1-[quinolyl-(2)]-3,5-diphenylpyrazoline |
| (46) | 1-[quinolyl-(2)]-5,5-diphenyl-3-(4-N,N—diethylaminophenyl)pyrazoline |
| (47) | 1-[lepidyl-(2)]-3,5-di-(4-N,N—dimethylaminophenyl)-pyrazoline |
| (48) | 1-[lepidyl-(2)]-3,5-di-(4-N,N—diethylaminophenyl)-pyrazoline |
| (49) | 1-[lepidyl-(2)]-3,5-di-(4-N,N—dibenzylamino-phenyl)pyrazoline |
| (50) | 1-[lepidyl-(2)]-3,5-di-(4-N—ethyl-N—propylamino-phenyl)pyrazoline |
| (51) | 1-[lepidyl-(2)]-3-(4-N,N—diethylaminophenyl)-5-(4-N,N—dibenzylaminophenyl)pyrazoline |
| (52) | 1-[lepidyl-(2)]-3,5-di-(4-morpholinophenyl)-pyrazoline |
| (53) | 1-[lepidyl-(2)]-3,5-di-(4-piperidinophenyl)-pyrazoline |
| (54) | 1-[lepidyl-(2)]-3,5-di-(4-pyrrolidinophenyl)-pyrazoline |
| (55) | 1-[lepidyl-(2)]-3,5-di-(4-methoxyphenyl)-pyrazoline |
| (56) | 1-[lepidyl-(2)]-3,5-di-(4-ethoxyphenyl)pyrazoline |
| (57) | 1-[lepidyl-(2)]-3-(4-N,N—diethylaminophenyl)-5-(4-methoxyphenyl)pyrazoline |
| (58) | 1-[lepidyl-(2)]-3,5-diphenylpyrazoline |
| (59) | 1-[carbazolyl-(3)]-3,5-di-(4-N,N—dimethylamino-phenyl)pyrazoline |
| (60) | 1-[carbazolyl-(3)]-3,5-di-(4-N,N—diethylamino-phenyl)pyrazoline |

These compounds are readily prepared by known synthetic methods, for instance, by refluxing an unsaturated ketone and a hydrazino compound represented by the following formulae (a) and (b), respectively, in alcohol in the presence of a small amount of acetic acid for several hours.

(a)

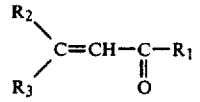

(b) $X_1—NH—NH_2$ ($R_1$, $R_2$, $R_3$ and $X_1$ are as defined above)

| | |
|---|---|
| (61) | 1-[pyridyl-(3)]-3-(4-N,N—dimethylaminostyryl)-4-methyl-5-(4-N,N—dimethylaminophenyl)pyrazoline |
| (62) | 1-[pyridyl-(3)]-3-(4-N,N—diethylaminostyryl)-4-methyl-5-(4-N,N—diethylaminophenyl)pyrazoline |
| (63) | 1-[pyridyl-(3)]-3-(4-N,N—dibenzylaminostyryl)-4-methyl-5-(4-N,N—dibenzylaminophenyl)pyrazoline |
| (64) | 1-[pyridyl-(3)]-3-(4-N—ethyl-N—propylaminostyryl)-4-methyl-5-(4-N—ethyl-N—propylaminophenyl)pyrazoline |

-continued

(65) 1-[pyridyl-(3)]-3-(4-N,N—diethylaminostyryl)-4-methyl-5-(4-N,N—dibenzylaminophenyl)pyrazoline
(66) 1-[pyridyl-(3)]-3-(4-morpholinostyryl)-4-methyl-5-(4-morpholinophenyl)pyrazoline
(67) 1-[pyridyl-(3)]-3-(4-piperidinostyryl)-4-methyl-5-(4-piperidinophenyl)pyrazoline
(68) 1-[pyridyl-(3)]-3-(4-pyrrolidinostyryl)-4-methyl-5-(4-pyrrolidinophenyl)pyrazoline
(69) 1-[pyridyl-(3)]-3-(4-methoxystyryl)-4-methyl-5-(4-methoxyphenyl)pyrazoline
(70) 1-[pyridyl-(3)]-3-(4-ethoxystyryl)-4-methyl-5-(4-ethoxyphenyl)pyrazoline
(71) 1-[pyridyl-(3)]-3-(4-N,N—diethylaminostyryl)-4-methyl-5-(4-methoxyphenyl)pyrazoline
(72) 1-[pyridyl-(3)]-4-methyl-5,5-diphenyl-3-(4-N,N—diethylaminostyryl)pyrazoline
(73) 1-[pyridyl-(3)]-4-methyl-3,5-di-(4-N,N—diethylaminophenyl)pyrazoline
(74) 1-[pyridyl-(3)]-4-methyl-3,5-di-(4-N,N—dibenzylaminophenyl)pyrazoline
(75) 1-[pyridyl-(3)]-4-methyl-3,5-di-(4-morpholinophenyl)pyrazoline
(76) 1-[pyridyl-(3)]-3-(4-N,N—dimethylaminostyryl)-4-ethyl-5-(4-N,N—dimethylaminophenyl)pyrazoline
(77) 1-[pyridyl-(3)]-3-(4-N,N—diethylaminostyryl)-4-ethyl-5-(4-N,N—diethylaminophenyl)pyrazoline
(78) 1-[pyridyl-(3)]-3-(4-N,N—dibenzylaminostyryl)-4-ethyl-5-(4-N,N—dibenzylaminophenyl)pyrazoline
(79) 1-[pyridyl-(3)]-3-(4-N—ethyl-N—propylamino-styryl)-4-ethyl-5-(4-N—ethyl-N—propylaminophenyl)-pyrazoline
(80) 1-[pyridyl-(3)]-3-(4-N,N—diethylaminostyryl)-4-ethyl-5-(4-N,N—dibenzylaminophenyl)pyrazoline
(81) 1-[pyridyl-(3)]-3-(4-morpholinostyryl)-4-ethyl-5-(4-morpholinophenyl)pyrazoline
(82) 1-[pyridyl-(3)]-3-(4-piperidinostyryl)-4-ethyl-5-(4-piperidinophenyl)pyrazoline
(83) 1-[pyridyl-(3)]-3-(4-pyrrolidinostyryl)-4-ethyl-5-(4-pyrrolidinophenyl)pyrazoline
(84) 1-[pyridyl-(3)]-3-(4-methoxystyryl)-4-ethyl-5-(4-methoxyphenyl)pyrazoline
(85) 1-[pyridyl-(3)]-3-(4-ethoxystyryl)-4-ethyl-5-(4-ethoxyphenyl)pyrazoline
(86) 1-[pyridyl-(3)]-3-(4-N,N—diethylaminostyryl)-4-ethyl-5-(4-methoxyphenyl)pyrazoline
(87) 1-[pyridyl-(3)]-4-ethyl-5,5-diphenyl-3-(4-N,N—diethylaminostyryl)pyrazoline
(88) 1-[pyridyl-(3)]-4-ethyl-3,5-di-(4-N,N—diethylaminophenyl)pyrazoline
(89) 1-[pyridyl-(3)]-4-ethyl-3,5-di-(4-N,N—dibenzylaminophenyl)pyrazoline
(90) 1-[pyridyl-(3)]-4-ethyl-3,5-di-(4-morpholinophenyl)pyrazoline
(91) 1-[pyridyl-(3)]-3-(4-N,N—dimethylaminostyryl)-4-benzyl-5-(4-N,N—dimethylaminophenyl)pyrazoline
(92) 1-[pyridyl-(3)]-3-(4-N,N—diethylaminostyryl)-4-benzyl-5-(4-N,N—diethylaminophenyl)pyrazoline
(93) 1-[pyridyl-(3)]-3-(4-N,N—dibenzylaminostyryl)-4-benzyl-5-(4-N,N—dibenzylaminophenyl)pyrazoline
(94) 1-[pyridyl-(3)]-3-(4-N—ethyl-N—propylamino-styryl)-4-chloro-5-(4-N—ethyl-N—propylaminophenyl)-pyrazoline
(95) 1-[pyridyl-(3)]-3-(4-N,N—diethylaminostyryl)-4-benzyl-5-(4-N,N—dibenzylaminophenyl)pyrazoline
(96) 1-[pyridyl-(3)]-3-(4-morpholinostyryl)-4-benzyl-5-(4-morpholinophenyl)pyrazoline
(97) 1-[pyridyl-(3)]-3-(4-piperidinostyryl)-4-benzyl-5-(4-piperidinophenyl)pyrazoline
(98) 1-[pyridyl-(3)]-3-(4-pyrrolidinostyryl)-4-benzyl-5-(4-pyrrolidinophenyl)pyrazoline
(99) 1-[pyridyl-(3)]-3-(4-methoxystyryl)-4-benzyl-5-(4-methoxyphenyl)pyrazoline
(100) 1-[pyridyl-(3)]-3-(4-ethoxystyryl)-4-benzyl-5-(4-ethoxyphenyl)pyrazoline
(101) 1-[pyridyl-(3)]-3-(4-N,N—diethylaminostyryl)-4-benzyl-5-(4-methoxyphenyl)pyrazoline
(102) 1-[pyridyl-(3)]-4-benzyl-5,5-diphenyl-3-(4-N,N—diethylaminostyryl)pyrazoline
(103) 1-[pyridyl-(3)]-4-benzyl-3,5-di-(4-N,N—diethylaminophenyl)pyrazoline
(104) 1-[pyridyl-(3)]-4-benzyl-3,5-di-(4-N,N—dibenzylaminophenyl)pyrazoline -continued (105) 1-[pyridyl-(3)]-4-benzyl-3,5-di-(4-morpholinophenyl)pyrazoline
(106) 1-[pyridyl-(3)]-3-(4-N,N—dimethylaminostyryl)-4-phenyl-5-(4-N,N—dimethylaminophenyl)pyrazoline
(107) 1-[pyridyl-(3)]-3-(4-N,N—diethylaminostyryl)-4-phenyl-5-(4-N,N—diethylaminophenyl)pyrazoline
(108) 1-[pyridyl-(3)]-3-(4-N,N—diethylaminostyryl)-4-(4-methylphenyl)-5-(4-N,N—dibenzylaminophenyl)-pyrazoline
(109) 1-[pyridyl-(3)]-3-(4-N,N—diethylaminostyryl)-4-(3-methoxyphenyl)-5-(4-N,N—dibenzylaminophenyl)-pyrazoline
(110) 1-[pyridyl-(3)]-3-(4-morpholinostyryl)-4-phenyl-5-(4-morpholinophenyl)pyrazoline
(111) 1-[pyridyl-(3)]-3-(4-piperidinostyryl)-4-phenyl-5-(4-piperidinophenyl)pyrazoline
(112) 1-[pyridyl-(3)]-3-(4-pyrrolidinostyryl)-4-phenyl-5-(4-pyrrolidinophenyl)-pyrazoline
(113) 1-[6-methoxy-pyridyl-(2)]-3-(4-N,N—dimethyl-aminostyryl)-4-methyl-5-(4-N,N—dimethylaminophenyl)-pyrazoline
(114) 1-[6-methoxy-pyridyl-(2)]-3-(4-N,N—diethyl-aminostyryl)-4-methyl-5-(4-N,N—diethylaminophenyl)-pyrazoline
(115) 1-[6-methoxy-pyridyl-(2)]-3-(4-N,N—dibenzylaminostyryl)-4-ethyl-5-(4-N,N—dibenzylamino-phenyl)pyrazoline
(116) 1-[6-methoxy-pyridyl-(2)]-3-(4-N—ethyl-N—propylaminostyryl)-4-phenyl-5-(4-N—ethyl-N—propyl-aminophenyl)pyrazoline
(117) 1-[6-methoxy-pyridyl-(2)]-3-(4-N,N—diethylaminostyryl)-4-chloro-5-(4-N,N— dibenzylamino-phenyl)pyrazoline
(118) 1-[6-methoxy-pyridyl-(2)]-3-(4-morpholino-styryl)-4-methyl-5-(4-morpholinophenyl)pyrazoline
(119) 1-[6-methoxy-pyridyl-(2)]-3-(4-piperidino-styryl)-4-methyl-5-(4-piperidinophenyl)pyrazoline
(120) 1-[6-methoxy-pyridyl-(2)]-3-(4-pyrrolidino-styryl)-4-methyl-5-(4-pyrrolidinophenyl)pyrazoline
(121) 1-[6-methoxy-pyridyl-(2)]-3-(4-methoxy-styryl)-4-methyl-5-(4-methoxyphenyl)pyrazoline
(122) 1-[6-methoxy-pyridyl-(2)]-3-(4-ethoxystyryl)-4-methyl-5-(4-ethoxyphenyl)pyrazoline
(123) 1-[6-methoxy-pyridyl-(2)]-3-(4-N,N—diethylaminostyryl)-4-methyl-5-(4-methoxyphenyl)pyrazoline
(124) 1-[quinolyl-(2)]-3-(4-N,N—dimethylamino-styryl)-4-methyl-5-(4-N,N—dimethylaminophenyl)-pyrazoline
(125) 1-[quinolyl-(2)]-3-(4-N,N—diethylamino-styryl)-4-methyl-5-(4-N,N—diethylaminophenyl)pyrazoline
(126) 1-[quinolyl-(2)]-3-(4-N,N—dibenzylamino-styryl)-4-ethyl-5-(4-N,N—dibenzylaminophenyl)pyrazoline
(127) 1-[quinolyl-(2)]-3-(4-N—ethyl-N—propylaminostyryl)-4-methyl-5-(4-N—ethyl-N—propylaminophenyl)-pyrazoline
(128) 1-[quinolyl-(2)]-3-(4-N,N—diethylamino-styryl)-4-methyl-5-(4-N,N—dibenzylaminophenyl)-pyrazoline
(129) 1-[quinolyl-(2)]-3-(4-morpholinostyryl)-4-methyl-5-(4-morpholinophenyl)pyrazoline
(130) 1-[quinolyl-(2)]-3-(4-piperidinostyryl)-4-methyl-5-(4-piperidinophenyl)pyrazoline
(131) 1-[quinolyl-(2)]-3-(4-pyrrolidinostyryl)-4-methyl-5-(4-pyrrolidinophenyl)pyrazoline
(132) 1-[quinolyl-(2)]-3-(4-methoxystyryl)-4-methyl-5-(4-methoxyphenyl)pyrazoline
(133) 1-[quinolyl-(2)]-3-(4-ethoxystyryl)-4-methyl-5-(4-ethoxyphenyl)pyrazoline
(134) 1-[quinolyl-(2)]-3-(4-N,N—dimethylamino-styryl)-4-methyl-5-(4-methoxyphenyl)pyrazoline
(135) 1-[lepidyl-(2)]-3-(4-N,N—dimethylamino-styryl)-4-methyl-5-(4-N,N—dimethylaminophenyl)-pyrazoline
(136) 1-[lepidyl-(2)]-3-(4-N,N—diethylamino-styryl)-4-methyl-5-(4-N,N—diethylaminophenyl)pyrazoline
(137) 1-[lepidyl-(2)]-3-(4-N,N—dibenzylamino-styryl)-4-propyl-5-(4-N,N—dibenzylaminophenyl)pyrazoline
(138) 1-[lepidyl-(2)]-3-(4-N—ethyl-N—propyl-aminostyryl)-4-(4-methylbenzyl)-5-(4-N—ethyl-N—propylaminophenyl)pyrazoline
(139) 1-[lepidyl-(2)]-3-(4-N,N—diethylaminostyryl)-4-methyl-5-(4-N,N—dibenzylaminophenyl)pyrazoline
(140) 1-[lepidyl-(2)]-3-(4-morpholinostyryl)-

-continued 4-methyl-5-(4-morpholinophenyl)pyrazoline
(141) 1-[lepidyl-(2)]-3-(4-piperidinostyryl)-4-methyl-5-(4-piperidinophenyl)pyrazoline
(142) 1-[lepidyl-(2)]-3-(4-pyrrolidinostyryl)-4-methyl-5-(4-pyrrolidinophenyl)pyrazoline
(143) 1-[lepidyl-(2)]-3-(4-methoxystyryl)-4-methyl-5-(4-methoxyphenyl)pyrazoline
(144) 1-[lepidyl-(2)]-3-(4-ethoxystyryl)-4-methyl-5-(4-ethoxyphenyl)pyrazoline
(145) 1-[lepidyl-(2)]-3-(4-N,N—diethylamino-styryl)-4-methyl-5-(4-methoxyphenyl)pyrazoline
(146) 1-[pyridyl-(2)]-3-(4-N,N—dimethylamino-styryl)-4-methyl-5-(4-N,N—dimethylaminophenyl)-pyrazoline
(147) 1-[pyridyl-(2)]-3-(4-N,N—diethylamino-styryl)-4-methyl-5-(4-N,N—diethylaminophenyl)pyrazoline
(148) 1-[pyridyl-(2)]-3-(4-N,N—dibenzylamino-styryl)-4-methyl-5-(4-N,N—dibenzylaminophenyl)pyrazoline
(149) 1-[pyridyl-(2)]-3-(4-N—ethyl-N—propyl-aminostyryl)-4-methyl-5-(4-N—ethyl-N—propylaminophenyl)-pyrazoline
(150) 1-[pyridyl-(2)]-3-(4-N,N—diethylamino-styryl)-4-methyl-5-(4-N,N—dibenzylaminophenyl)pyrazoline
(151) 1-[pyridyl-(2)]-3-(4-morpholinostyryl)-4-methyl-5-(4-morpholinophenyl)pyrazoline
(152) 1-[pyridyl-(2)]-3-(4-piperidinostyryl)-4-methyl-5-(4-piperidinophenyl)pyrazoline
(153) 1-[pyridyl-(2)]-3-(4-pyrrolidinostyryl)-4-methyl-5-(4-pyrrolidinophenyl)pyrazoline
(154) 1-[pyridyl-(2)]-3-(4-methoxystyryl)-4-methyl-5-(4-methoxyphenyl)pyrazoline
(155) 1-[pyridyl-(2)]-3-(4-ethoxystyryl)-4-methyl-5-(4-ethoxyphenyl)pyrazoline
(156) 1-[pyridyl-(2)]-3-(4-N,N—diethylamino-styryl)-4-methyl-5-(4-methoxyphenyl)pyrazoline
(157) 1-[carbazolyl-(3)]-3-(4-N,N—dimethyl-aminostyryl)-4-methyl-5-(4-N,N—dimethylaminophenyl)-pyrazoline
(158) 1-[carbazolyl-(3)]-3-(4-N,N—diethylamino-styryl)-4-methyl-5-(4-N,N—diethylaminophenyl)pyrazoline
(159) 1-[carbazolyl-(3)]-3-(4-N,N—diethyl-aminostyryl)-4-phenyl-5-(4-N,N—diethylaminophenyl)-pyrazoline
(160) 1-[9-ethyl-carbazolyl-(3)]-3-(4-N,N—diethylaminostyryl)-4-methyl-5-(4-N,N—diethylamino-phenyl)pyrazoline
(161) 1-[9-ethyl-carbazolyl-(3)]-3-(4-N,N—diethylaminostyryl)-4-benzyl-5-(4-N,N—diethylamino-phenyl)pyrazoline
(162) 1-[pyridyl-(3)]-3-(α-methyl-4-N,N—diethylaminostyryl)-5-(4-N,N—diethylaminophenyl)-pyrazoline
(163) 1-[pyridyl-(3)]-3-(α-methyl-4-N,N—diethylaminostyryl)-4-methyl-5-(4-N,N—diethylamino-phenyl)pyrazoline
(164) 1-[lepidyl-(2)]-3-(α-benzyl-4-N,N—diethylaminostyryl)-4-methyl-5-(4-N,N—diethylamino-phenyl)pyrazoline These compounds are also readily prepared by known synthetic methods, for instance, by refluxing an unsaturated ketone and a hydrazino compound represented by the following formulae (c) and (d), respectively, in alcohol in the presence of a small amount of acetic acid for several hours.

Formula (c)

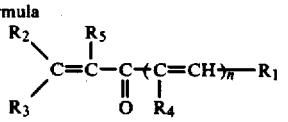

(d) $X_1—NH—NH_2$ (n, $R_1$, $R_2$, $R_3$, $R_4$, $R_5$ and $X_1$ are as defined above)

(165) 1-[pyridyl-(3)]-3-(4-N,N—dimethylamino-styryl)-5-[furyl-(2)]-pyrazoline
(166) 1-[pyridyl-(3)]-3-(4-N,N—diethylamino-styryl)-5-[furyl-(2)]-pyrazoline
(167) 1-[pyridyl-(3)]-3-(4-N,N—dibenzylamino-styryl)-5-[furyl-(2)]-pyrazoline
(168) 1-[pyridyl-(3)]-3-(4-N,N—dipropylamino-styryl)-5-[furyl-(2)]-pyrazoline
(169) 1-[pyridyl-(3)]-3-(4-N,N—dibuthyalimino-styryl)5-[furyl-(2)]-pyrazoline
(170) 1-[pyridyl-(3)]-3-(4-N—ethyl-N—butyl-aminostyryl)-5-[furyl-(2)]-pyrazoline
(171) 1-[pyridyl-(3)]-3-(4-N,N—diphenylamino-styryl)-5-[furyl-(2)]-pyrazoline
(172) 1-[pyridyl-(3)]-3-(4-piperidinostyryl)-5-[furyl-(2)]-pyrazoline
(173) 1-[pyridyl-(3)]-3-(4-pyrrolidinostyryl)-5-[furyl-(2)]-pyrazoline
(174) 1-[pyridyl-(3)]-3-(4-morpholinostyryl)-5-[furyl-(2)]-pyrazoline
(175) 1,5-di-[pyridyl-(3)]-3-(4-N,N—diethylaminostyryl)pyrazoline
(176) 1,5-di-[pyridyl-(3)]-3-(4-N,N—dibenzylaminostyryl)pyrazoline
(177) 1,5-di-[pyridyl-(3)]-3-(4-piperidino-styryl)pyrazoline
(178) 1-[pyridyl-(3)]-3-(4-N,N—diethylamino-styryl)-5-[N—methyl-imidazolyl-(4)]pyrazoline
(179) 1-[pyridyl-(3)]-3-(4-N,N—dibenzylamino-styryl)-5-[N—methyl-imidazolyl-(4)]pyrazoline
(180) 1-[pyridyl-(3)]-3-(4-N,N—diethylamino-styryl)-5-[N—3-methoxypropyl-imidazolyl-(4)]pyrazoline
(181) 1-[pyridyl-(3)]-3-(4-N,N—diethylamino-styryl)-5-[N—ethyl-oxazolyl-(4)]pyrazoline
(182) 1-[pyridyl-(3)]-3-(4-N,N—diethylamino-styryl)-5-[N—ethyl-carbazolyl-(3)]pyrazoline
(183) 1-[pyridyl-(3)]-3-(4-N,N—diethylamino-styryl)-5-[N—ethyl-thiazolyl-(4)]pyrazoline
(184) 1,5-di-[pyridyl-(3)]-3-(4-N,N—diethylaminophenyl)pyrazoline
(185) 1-[pyridyl-(3)]-3-[β-(3-pyridyl)vinyl] -5-[furyl-(2)]-pyrazoline
(186) 1-[pyridyl-(3)]-3-[β-(2-furyl)vinyl]-5-[furyl-(2)]pyrazoline
(187) 1-[pyridyl-(3)]-3,5-di-[furyl-(2)]pyrazoline
(188) 1-[pyridyl-(3)]-3-(4-N,N—diethylamino-styryl)-4-methyl-5-[furyl-(2)]pyrazoline
(189) 1-[pyridyl-(3)]-3-(4-N,N—diethylamino-styryl)-4-benzyl-5-[furyl-(2)]pyrazoline
(190) 1-[pyridyl-(3)]-3-(4-N,N—diethylamino-styryl)-4-phenyl-5-[furyl-(2)]pyrazoline
(191) 1-[pyridyl-(3)]-3-(α-methyl-4-N,N—diethylaminostyryl)-5-[furyl-(2)]pyrazoline
(192) 1-[pyridyl-(3)]-3-(α-benzyl-4-N,N—diethylaminostyryl)-5-[furyl-(2)]pyrazoline
(193) 1-[pyridyl-(3)]-3-(α-phenyl-4-N,N—diethylaminostyryl)-5-[furyl-(2)]pyrazoline
(194) 1-[quinolyl-(2)]-3-(4-N,N—dimethylamino-styryl)-5-[furyl-(2)]pyrazoline
(195) 1-[quinolyl-(2)]-3-(4-N,N—diethylamino-styryl)-5-[furyl-(2)]pyrazoline
(196) 1-[quinolyl-(2)]-3-(4-N,N—dibenzylamino-styryl)-5-[furyl-(2)]pyrazoline
(197) 1-[quinolyl-(2)]-3-(4-N,N—dipropylamino-styryl)-5-[furyl-(2)]pyrazoline
(198) 1-[quinolyl-(2)]-3-(4-N,N—dibutylamino-styryl)-5-[furyl-(2)]pyrazoline
(199) 1-[quinolyl-(2)]-3-(4-N—ethyl-N—butylaminostyryl)-5-[furyl-(2)]pyrazoline
(200) 1-[quinolyl-(2)]-3-(4-N,N—diphenylamino-styryl)-5-[furyl-(2)]pyrazoline
(201) 1-[quinolyl-(2)]-3-(4-piperidinostyryl)-5-[furyl-(2)]pyrazoline
(202) 1-[quinolyl-(2)]-3-(4-pyrrolidinostyryl)-5-[furyl-(2)]pyrazoline
(203) 1-[quinolyl-(2)]-3-(4-morpholinostyryl)-5-[furyl-(2)]pyrazoline
(204) 1,5-di-[quinolyl-(2)]-3-(4-N,N—diethyl-aminostyryl)pyrazoline
(205) 1,5-di-[quinolyl-(2)]-3-(4-N,N—dibenzylaminostyryl)pyrazoline
(206) 1,5-di-[quinolyl-(2)]-3-(4-piperidino- -continued styryl)pyrazoline (207) 1-[quinolyl-(2)] -3-(4-N,N—diethylamino-styryl)-5-[N—methyl-imidazolyl-(4)]pyrazoline (208) 1-[quinolyl-(2)]-3-(4-N,N—dibenzylamino-styryl)-5-[N—methyl-imidazolyl-(4)]pyrazoline (209) 1-[quinolyl-(2)]-3-(4-N,N—diethylamino-styryl)-5-[N—3-methoxypropyl-imidazolyl-(4)]pyrazoline (210) 1-[quinolyl-(2)]-3-(4-N,N—diethylamino-styryl)-5-[N—ethyl-oxazolyl-(4)]pyrazoline (211) 1-[quinolyl-(2)]-3-(4-N,N—diethylamino-styryl)-5-[N—ethyl-carbazolyl-(3)]pyrazoline (212) 1-[quinolyl-(2)]-3-(4-N,N—diethylamino-styryl)-5-[N—ethyl-thiazolyl-(4)]pyrazoline (213) 1,5-di-[quinolyl-(2)]-3-(4-N,N—diethylaminophenyl)pyrazoline (214) 1-[quinolyl-(2)]-3-[β-(3-pyridyl)vinyl]-5-[furyl-(2)]pyrazoline (215) 1-[quinolyl-(2)]-3-[β-(2-furyl)vinyl]-5-[furyl-(2)]pyrazoline (216) 1-[quinolyl-(2)]-3,5-di-[furyl-(2)]-pyrazoline (217) 1-[quinolyl-(2)]-3-(4-N,N—diethylamino-styryl)-4-methyl-5-[furyl-(2)]pyrazoline (218) 1-[quinolyl-(2)]-3-(4-N,N—diethylamino-styryl)-4-benzyl-5-[furyl-(2)]pyrazoline (219) 1-[quinolyl-(2)]-3-(4-N,N—diethylamino-styryl)-4-phenyl-5-[furyl-(2)]pyrazoline (220) 1-[quinolyl-(2)]-3-(α-methyl-4-N,N—diethylaminostyryl)-5-[furyl-(2)]pyrazoline (221) 1-[quinolyl-(2)]-3-(α-benzyl-4-N,N—diethylaminostyryl)-5-[furyl-(2)]pyrazoline (222) 1-[quinolyl-(2)]-3-(α-phenyl-4-N,N—diethylaminostyryl)-5-[furyl-(2)]pyrazoline (223) 1-[lepidyl-(2)]-3-(4-N,N—dimethylamino-styryl)-5-[furyl-(2)]pyrazoline (224) 1-[lepidyl-(2)]-3-(4-N,N—diethylamino-styryl)-5-[furyl-(2)]pyrazoline (225) 1-[lepidyl-(2)]-3-(4-N,N—dibenzylamino-styryl)-5-[furyl-(2)]pyrazoline (226) 1-[lepidyl-(2)]-3-(4-N,N—dipropylamino-styryl)-5-[furyl-(2)]pyrazoline (227) 1-[lepidyl-(2)]-3-(4-N,N—dibutylamino-styryl)-5-[furyl-(2)]pyrazoline (228) 1-[lepidyl-(2)]-3-(4-N—ethyl-N—butylaminostyryl)-5-[furyl-(2)]pyrazoline (229) 1-[lepidyl-(2)]-3-(4-N,N—diphenylamino-styryl)-5-[furyl-(2)]pyrazoline (230) 1-[lepidyl-(2)]-3-(4-piperidinostyryl)-5-[furyl-(2)]pyrazoline (231) 1-[lepidyl-(2)]-3-(4-pyrrolidinostyryl)-5-[furyl-(2)]pyrazoline (232) 1-[lepidyl-(2)]-3-(4-morpholinostyryl)-5-[furyl-(2)]pyrazoline (233) 1,5-di-[lepidyl-(2)]-3-(4-N,N—diethyl-aminostyryl)pyrazoline (234) 1,5-di-[lepidyl-(2)]-3-(4-N,N—dibenzyl-aminostyryl)pyrazoline (235) 1,5-di-[lepidyl-(2)]-3-(4-piperidinostyryl)-pyrazoline (236) 1-[lepidyl-(2)]-3-(4-N,N—diethylamino-styryl)-5-[N—methyl-imidazolyl-(4)]pyrazoline (237) 1-[lepidyl-(2)]-3-(4-N,N—dibenzylamino-styryl)-5-[N—methyl-imidazolyl-(4)]pyrazoline (238) 1-[lepidyl-(2)]-3-(4-N,N—diethylamino-styryl)-5-[N—3-methoxypropyl-imidazolyl-(4)]pyrazoline (239) 1-[lepidyl-(2)]-3-(4-N,N—diethylamino-styryl)-5-[N—ethyl-oxazolyl-(4)]pyrazoline (240) 1-[lepidyl-(2)]-3-(4-N,N—diethylamino-styryl)-5-[N—ethyl-carbazolyl-(3)]pyrazoline (241) 1-[lepidyl-(2)]-3-(4-N,N—diethylamino-styryl)-5-[N—ethyl-thiazolyl-(4)]pyrazoline (242) 1,5-di-[lepidyl-(2)]-3-(4-N,N—diethylaminophenyl)pyrazoline (243) 1-[lepidyl-(2)]-3-[β-(3-pyridyl)vinyl]-5-[furyl-(2)]pyrazoline (244) 1-[lepidyl-(2)]-3-[β-(2-furyl)vinyl]-5-[furyl-(2)]pyrazoline (245) 1-[lepidyl-(2)]-3,5-di-[furyl-(2)]-pyrazoline (246) 1-[lepidyl-(2)]-3-(4-N,N—diethylamino-styryl)-4-methyl-5-[furyl-(2)]pyrazoline (247) 1-[lepidyl-(2)]-3-(4-N,N—diethylamino-styryl)-4-benzyl-5-[furyl-(2)]pyrazoline (248) 1-[lepidyl-(2)]-3-(4-N,N— diethylamino-styryl)-4-phenyl-5-[furyl-(2)]pyrazoline (249) 1-[lepidyl-(2)]-3-(α-methyl-4-N,N—diethylaminostyryl)-5-[furyl-(2)]pyrazoline (250) 1-[lepidyl-(2)]-3-(α-benzyl-4-N,N—diethylaminostyryl)-5-[furyl-(2)]pyrazoline (251) 1-[lepidyl-(2)]-3-(α-phenyl-4-N,N—diethylaminostyryl)-5-[furyl-(2)]pyrazoline (252) 1-[pyridyl-(2)]3-(4-N,N—dimethylamino-styryl)-5-[furyl-(2)]pyrazoline (253) 1-[pyridyl-(2)]-3-(4-N,N—diethylamino-styryl)-5-[furyl-(2)]pyrazoline (254) 1-[pyridyl-(2)]-3-(4-N,N—dibenzylamino-styryl)-5-[furyl-(2)]pyrazoline (255) 1-[pyridyl-(2)]-3-(4-N,N—dipropylamino-styryl)-5-[furyl-(2)]pyrazoline (256) 1-[6-methoxy-pyridyl-(2)]-3-(4-N,N—dibutylaminostyryl)-5-[furyl-(2)]pyrazoline (257) 1-[pyridyl-(2)]-3-(4-N—ethyl-N—butyl-aminostyryl)-5-[furyl-(2)]pyrazoline (258) 1-[pyridyl-(2)]-3-(4-N,N—diphenylamino-styryl)-5-[furyl-(2)]-pyrazoline (259) 1-[pyridyl-(2)]-3-(4-piperidinostyryl)-5-[furyl-(2)]pyrazoline (260) 1-[pyridyl-(2)]-3-(4-pyrrolidinostyryl)-5-[furyl-(2)]pyrazoline (261) 1-[pyridyl-(2)]-3-(4-morpholinostyryl)-5-[furyl-(2)]pyrazoline (262) 1,5-di-[pyridyl-(2)]-3-(4-N,N—diethyl-aminostyryl)pyrazoline (263) 1,5-di-[pyridyl-(2)]-3-(4-N,N—dibenzyl-aminostyryl)pyrazoline (264) 1,5-di-[pyridyl-(2)]-3-(4-piperidino-styryl)pyrazoline (265) 1-[pyridyl-(2)]-3-(4-N,N—diethylamino-styryl)-5-[N—methyl-imidazolyl-(4)]pyrazoline (266) 1-[pyridyl-(2)]-3-(4-N,N—dibenzylamino-styryl)-5-[N—methyl-imidazolyl-(4)]pyrazoline (267) 1-[pyridyl-(2)]-3-(4-N,N—diethylamino-styryl)-5-[N—3-methoxypropyl-imidazolyl-(4)]pyrazoline (268) 1-[pyridyl-(2)]-3-(4-N,N—diethylamino-styryl)-5-[N—ethyl-oxazolyl-(4)]pyrazoline (269) 1-[pyridyl-(2)]-3-(4-N,N—diethylamino-styryl)-5-[N—ethyl-carbazolyl-(3)]pyrazoline (270) 1-[pyridyl-(2)]-3-(4-N,N—diethylamino-styryl)-5-[N—ethyl-thiazolyl-(4)]pyrazoline (271) 1,5-di-[pyridyl-(2)]-3-(4-N,N—diethylamino-phenyl)pyrazoline (272) 1-[pyridyl-(2)]-3-[β-(3-pyridyl)vinyl]-5-[furyl-(2)]pyrazoline (273) 1-[pyridyl-(2)]-3-[β-(2-furyl)vinyl]-5-[furyl-(2)]pyrazoline (274) 1-[pyridyl-(2)]-3,5-di-[furyl-(2)]-pyrazoline (275) 1-[pyridyl-(2)]-3-(4-N,N—diethylamino-styryl)-4-methyl-5-[furyl-(2)]pyrazoline (276) 1-[pyridyl-(2)]-3-(4-N,N—diethylamino-styryl)-4-benzyl-5-[furyl-(2)]pyrazoline (277) 1-[pyridyl-(2)]-3-(4-N,N—diethylamino-styryl)-4-phenyl-5-[furyl-(2)]pyrazoline (278) 1-[pyridyl-(2)]-3-(α-methyl-4-N,N—diethylaminostyryl)-5-[furyl-(2)]pyrazoline (279) 1-[pyridyl-(2)]-3-(α-benzyl-4-N,N—diethylaminostyryl)-5-[furyl-(2)]pyrazoline (280) 1-[pyridyl-(2)]-3-(α-phenyl-4-N,N—diethylaminostyryl)-5-[furyl-(2)]pyrazoline (281) 1-[pyridyl-(2)]-3-(4-methoxystyryl)-5-[furyl-(2)]pyrazoline (282) 1-[quinolyl-(2)]-3-(4-methoxystyryl)-5-[furyl-(2)]pyrazoline (283) 1-[N—ethyl-carbazolyl-(3)]-3-(4-N,N—diethylaminostyryl)-5-[furyl-(2)]pyrazoline These compounds are also readily prepared by known synthetic methods, for instance, by refluxing an unsaturated ketone and a hydrazino compound represented by the following formulae (e) and (f), respectively, in alcohol in the presence of a small amount of acetic acid for several hours.

Formula (e) $R_2-CH=C(R_5)-C(=O)-(C(R_4)=CH)_n-R_1$ (f) $X_1-NH-NH_2$ ($R_1$, $R_2$, $R_4$, $R_5$, $X_1$, and n are as defined above)

284) 1-[pyridyl-(3)]-3-[β-(2-furyl)vinyl]-5-(4-N,N—dimethylaminophenyl)pyrazoline
285) 1-[pyridyl-(3)]-3-[β-(2-furyl)vinyl]-5-(4-N,N—diethylaminophenyl)pyrazoline
286) 1-[pyridyl-(3)]-3-[β-(2-furyl)vinyl]-5-(4-N,N—dibenzylaminophenyl)pyrazoline
287) 1-[pyridyl-(3)]-3-[β-(2-furyl)vinyl]-5-(4-N—ethyl-N—propylaminophenyl)pyrazoline
288) 1-[pyridyl-(3)]-3-[β-(2-furyl)vinyl]-5-(4-N,N—dibutylaminophenyl)pyrazoline
289) 1-[pyridyl-(3)]-3-[β-(2-furyl)vinyl]-4-methyl-5-(4-N,N—diethylaminophenyl)pyrazoline
290) 1-[pyridyl-(3)]-3-[β-(2-furyl)vinyl]-4-benzyl-5-(4-N,N—diethylaminophenyl)pyrazoline
291) 1-[pyridyl-(3)]-3-[β-(2-furyl)vinyl]-4-phenyl-5-(4-N,N—diethylaminophenyl)pyrazoline
292) 1-[pyridyl-(3)]-3-[α-methyl-β-(2-furyl)-vinyl]-5-(4-N,N—diethylaminophenyl)pyrazoline
293) 1-[pyridyl-(3)]-3-[α-benzyl-β-(2-furyl)-vinyl]-5-(4-N,N—diethylaminophenyl)pyrazoline
294) 1-[pyridyl-(3)]-3-[α-phenyl-β-(2-furyl)-vinyl]-5-(4-N,N—diethylaminophenyl)pyrazoline
295) 1-[pyridyl-(3)]-3-[furyl-(2)]-5-(4-N,N—diethylaminophenyl)pyrazoline
296) 1-[pyridyl-(3)]-3-[β-(N—ethyl-3-carbazolyl)vinyl]-5-(4-N,N—diethylaminophenyl)pyrazoline
297) 1-[pyridyl-(3)]-3-[β-(N—methyl-4-imidazolyl)vinyl]-5-(4-N,N—diethylaminophenyl)pyrazoline
298) 1-[pyridyl-(3)]-3-[β-(N—ethyl-4-imidazolyl)vinyl]-5-(4-N,N—diethylaminophenyl)pyrazoline
299) 1-[pyridyl-(3)]-3-[β-(N—ethyl-4-oxazolyl)vinyl]-5-(4-N,N—diethylaminophenyl)pyrazoline
300) 1-[pyridyl-(3)]-3-[β-(N—ethyl-4-thiazolyl)vinyl]-5-(4-N,N—diethylaminophenyl)pyrazoline
301) 1,3-di-[pyridyl-(3)]-5-(4-N,N—diethylaminophenyl)pyrazoline
302) 1-[pyridyl-(3)]-3-[β-(N—ethyl-3-carbazolyl)vinyl]-5-(4-methoxyphenyl)pyrazoline
303) 1-[pyridyl-(3)]-3-[α-methyl-β-(2-furyl)vinyl]-4-methyl-5-(4-methoxyphenyl)pyrazoline
304) 1-[quinolyl-(2)]-3-[β-(2-furyl)vinyl]-5-(4-N,N—dimethylaminophenyl)pyrazoline
305) 1-[quinolyl-(2)]-3-[β-(2-furyl)vinyl]-5-(4-N,N—diethylaminophenyl)pyrazoline
306) 1-[quinolyl-(2)]-3-[β-(2-furyl)vinyl]-5-(4-N,N—dibenzylaminophenyl)pyrazoline
307) 1-[quinolyl-(2)]-3-[β-(2-furyl)vinyl]-5-(4-N—ethyl-N—propylaminophenyl)pyrazoline
308) 1-[quinolyl-(2)]-3-[β-(2-furyl)vinyl]-5-(4-N,N—dibutylaminophenyl)pyrazoline
309) 1-[quinolyl-(2)]-3-[β-(2-furyl)vinyl]-4-methyl-5-(4-N,N—diethylaminophenyl)pyrazoline
(310) 1-[quinolyl-(2)]-3-[β-(2-furyl)vinyl]-4-benzyl-5-(4-N,N—diethylaminophenyl)pyrazoline
(311) 1-[quinolyl-(2)]-3-[β-(2-furyl)vinyl]-4-phenyl-5-(4-N,N—diethylaminophenyl)pyrazoline
(312) 1-[quinolyl-(2)]-3-[α-methyl-β-(2-furyl)vinyl]-5-(4-N,N—diethylaminophenyl)pyrazoline
(313) 1-[quinolyl-(2)]-3-[α-benzyl-β-(2-furyl)vinyl]-5-(4-N,N—diethylaminophenyl)pyrazoline
(314) 1-[quinolyl-(2)]-3-[α-phenyl-β-(2-furyl)vinyl]-5-(4-N,N—diethylaminophenyl)pyrazoline
(315) 1-[quinolyl-(2)]-3-[furyl-(2)]-5-(4-N,N—diethylaminophenyl)pyrazoline
(316) 1-[quinolyl-(2)]-3-[β-(N—ethyl-3-carbazolyl)vinyl]-5-(4-N,N—diethylaminophenyl)-pyrazoline
(317) 1-[quinolyl-(2)]-3-[β-(N—methyl-4-imidazolyl)vinyl]-5-(4-N,N—diethylaminophenyl)-pyrazoline -continued (318) 1-[quinolyl-(2)]-3-[β-(N—ethyl-4-imidazolyl)vinyl]-5-(4-N,N—diethylaminophenyl)-pyrazoline
(319) 1-[quinolyl-(2)]-3-[β-(N—ethyl-4-oxazolyl)vinyl]-5-(4-N,N— diethylaminophenyl)-pyrazoline
(320) 1-[quinolyl-(2)]-3-[β-(N—ethyl-4-thiazolyl)vinyl]-5-(4-N,N—diethylaminophenyl)-pyrazoline
(321) 1,3-di-[quinolyl-(2)]-5-(4-N,N—diethylaminophenyl)pyrazoline
(322) 1-[quinolyl-(2)]-3-[β-(N—ethyl-3-carbazolyl)vinyl]-5-(4-methoxyphenyl)pyrazoline
(323) 1-[quinolyl-(2)]-3-[α-methyl-β-(2-furyl)vinyl]-4-methyl-5-(4-methoxyphenyl)pyrazoline
(324) 1-[lepidyl-(2)]-3-[β-(2-furyl)vinyl]-5-(4-N,N—dimethylaminophenyl)pyrazoline
(325) 1-[lepidyl-(2)]-3-[β-(2-furyl)vinyl]-5-(4-N,N—diethylaminophenyl)pyrazoline
(326) 1-[lepidyl-(2)]-3-[β-(2-furyl)vinyl]-5-(4-N,N—dibenzylaminophenyl)pyrazoline
(327) 1-[lepidyl-(2)]-3-[β-(2-furyl)vinyl]-5-(4-N—ethyl-N—propylaminophenyl)pyrazoline
(328) 1-[lepidyl-(2)]-3-[β-(2-furyl)vinyl]-5-(4-N,N—dibutylaminophenyl)pyrazoline
(329) 1-[lepidyl-(2)]-3-[β-(2-furyl)vinyl]-4-methyl-5-(4-N,N—diethylaminophenyl)pyrazoline
(330) 1-[lepidyl-(2)]-3-[β-(2-furyl)vinyl]-4-benzyl-5-(4-N,N—diethylaminophenyl)pyrazoline
(331) 1-[lepidyl-(2)]-3-[β-(2-furyl)vinyl]-4-phenyl-5-(4-N,N—diethylaminophenyl)pyrazoline
(332) 1-[lepidyl-(2)]-3-[α-methyl-β-(2-furyl)vinyl]-5-(4-N,N—diethylaminophenyl)-pyrazoline
(333) 1-[lepidyl-(2)]-3-[α-benzyl-β-(2-furyl)vinyl]-5-(4-N,N—diethylaminophenyl)-pyrazoline
(334) 1-[lepidyl-(2)]-3-[α-phenyl-β-(2-furyl)vinyl]-5-(4-N,N—diethylaminophenyl)-pyrazoline
(335) 1-[lepidyl-(2)]-3-[furyl-(2)]-5-(4-N,N—diethylaminophenyl)pyrazoline
(336) 1-[lepidyl-(2)]-3-[β-(N—ethyl-3-carbazolyl)vinyl]-5-(4-N,N—diethylaminophenyl)-pyrazoline
(337) 1-[lepidyl-(2)]-3-[β-(N—methyl-4-imidazolyl)vinyl] -5-(4-N,N—diethylaminophenyl)-pyrazoline
(338) 1-[lepidyl-(2)]-3-[β-(N—ethyl-4-imidazolyl)vinyl]-5-(4-N,N—diethylaminophenyl)-pyrazoline
(339) 1-[lepidyl-(2)]-3-[β-(N—ethyl-4-oxazolyl)vinyl]-5-(4-N,N—diethylaminophenyl)-pyrazoline
(340) 1-[lepidyl-(2)]-3-[β-(N—ethyl-4-thiazolyl)vinyl]-5-(4-N,N—diethylaminophenyl)-pyrazoline
(341) 1,3-di-[lepidyl-(2)]-5-(4-N,N—diethylaminophenyl)pyrazoline
(342) 1-[lepidyl-(2)]-3-[β-(N—ethyl-3-carbazolyl)vinyl]-5-(4-methoxyphenyl)pyrazoline
(343) 1-[lepidyl-(2)]-3-[α-methyl-β-(2-furyl)vinyl]-4-methyl-5-(4-methoxyphenyl)-pyrazoline
(344) 1-[6-methoxy-pyridyl-(2)]-3-[β-(2-furyl)vinyl]-5-(4-N,N—dimethylaminophenyl)-pyrazoline
(345) 1-[6-methoxy-pyridyl-(2)]-3-[β-(2-furyl)vinyl]-5-(4-N,N—diethylaminophenyl)pyrazoline
(346) 1-[pyridyl-(2)]-3-[β-(2-furyl)vinyl]-5-(4-N,N—dibenzylaminophenyl)pyrazoline
(347) 1-[pyridyl-(2)]-3-[β-(2-furyl)vinyl]-5-(4-N—ethyl-N—propylaminophenyl)pyrazoline
(348) 1-[pyridyl-(2)]-3-[β-(2-furyl)vinyl]-5-(4-N,N—dibutylaminophenyl)pyrazoline
(349) 1-[pyridyl-(2)]-3-[β-(2-furyl)vinyl]-4-methyl-5-(4-N,N—diethylaminophenyl)pyrazoline
(350) 1-[pyridyl-(2)]-3-[β-(2-furyl)vinyl]-4-benzyl-5-(4-N,N—diethylaminophenyl)pyrazoline
(351) 1-[pyridyl-(2)]-3-[β-(2-furyl)vinyl]-4-phenyl-5-(4-N,N—diethylaminophenyl)pyrazoline
(352) 1-[pyridyl-(2)]-3-[α-methyl-β-

-continued (2-furyl)vinyl]-5-(4-N,N—diethylaminophenyl)-pyrazoline (353) 1-[pyridyl-(2)]-3-[α-benzyl-β-(2-furyl)vinyl]-5-(4-N,N—diethylaminophenyl)-pyrazoline (354) 1-[pyridyl-(2)]-3-[α-phenyl-β-(2-furyl)vinyl]-5-(4-N,N—diethylaminophenyl)-pyrazoline (355) 1-[pyridyl-(2)]-3-[furyl-(2)]-5-(4-N,N—diethylaminophenyl)pyrazoline (356) 1-[pyridyl-(2)]-3-[β-(N—ethyl-3-carbazolyl)vinyl]-5-(4-N,N—diethylaminophenyl)-pyrazoline (357) 1-[pyridyl-(2)]-3-[β-(N—methyl-4-imidazolyl)vinyl]-5-(4-N,N—diethylaminophenyl)-pyrazoline (358) 1-[pyridyl-(2)]-3-[β-(N—ethyl-4-imidazolyl)vinyl]-5-(4-N,N—diethylaminophenyl)-pyrazoline (359) 1-[pyridyl-(2)]-3-[β-(N—ethyl-4-oxazolyl)vinyl]-5-(4-N,N—diethylaminophenyl)-pyrazoline (360) 1-[pyridyl-(2)]-3-[β-(N—ethyl-4-thiazolyl)vinyl]-5-(4-N,N—diethylaminophenyl)-pyrazoline (361) 1,3-di-[pyridyl-(2)]-5-(4-N,N—diethylaminophenyl)pyrazoline (362) 1-[pyridyl-(2)]-3-[β-(N—ethyl-3-carbazolyl)vinyl]-5-(4-methoxyphenyl)pyrazoline (363) 1-[pyridyl-(2)]-3-[α-methyl-β-(2-furyl)vinyl]-4-methyl-5-(4-methoxyphenyl)-pyrazoline (364) 1-[N—ethyl-carbazolyl-(3)]-3-[β-(2-furyl)vinyl]-5-(4-N,N—diethylaminophenyl)-pyrazoline (365) 1-[pyridyl-(3)]-3-(4-methoxystyryl)-5-(4-N,N—dimethylaminophenyl)pyrazoline (366) 1-[pyridyl-(3)]-3-(4-methoxystyryl)-5-(4-N,N—diethylaminophenyl)pyrazoline (367) 1-[pyridyl-(3)]-3-(4-methoxystyryl)-5-(4-N,N—dibenzylaminophenyl)pyrazoline (368) 1-[pyridyl-(3)]-3-(4-methoxystyryl)-5-(4-N,N—dipropylaminiphenyl)pyrazoline (369) 1-[pyridyl-(3)]-3-(4-methoxystyryl)-5-(4-N—ethyl-N—benzylaminostyryl)pyrazoline (370) 1-[pyridyl-(3)]-3-(4-methoxystyryl)-5-(4-N,N—dibutylaminostyryl)pyrazoline (371) 1-[pyridyl-(3)]-3-(4-methoxystyryl)-5-(4-methoxyphenyl)pyrazoline (372) 1-[pyridyl-(3)]-3,5-di-(4-methoxyphenyl)pyrazoline (373) 1-[pyridyl-(3)]-3-(4-phenoxystyryl)-5-(4-N,N— diethylaminophenyl)pyrazoline (374) 1-[2-methylpyridyl-(3)]-3-(4-methoxystyryl)-5-(4-methoxyphenyl)pyrazoline (375) 1-[2-ethylpyridyl-(3)]-3-(4-methoxystyryl)-5-(4-methoxyphenyl)pyrazoline (376) 1-[pyridyl-(3)]-3-(4-ethoxystyryl)-5-(4-ethoxyphenyl)pyrazoline (377) 1-[quinolyl-(2)]-3-(4-methoxystyryl)-5-(4-N,N—dimethylaminophenyl)pyrazoline (378) 1-[quinolyl-(2)]-3-(4-methoxystyryl)-5-(4-N,N—diethylaminophenyl)pyrazoline (379) 1-[quinolyl-(2)]-3-(4-methoxystyryl)-5-(4-N,N—dibenzylaminophenyl)pyrazoline (380) 1-[quinolyl-(2)]-3-(4-methoxystyryl)-5-(4-N,N—dipropylaminophenyl)pyrazoline (381) 1-[quinolyl-(2)]-3-(4-methoxystyryl)-5-(4-N—ethyl-N—benzylaminostyryl)pyrazoline (382) 1-[quinolyl-(2)]-3-(4-methoxystyryl)-5-(4-N,N—dibutylaminostyryl)pyrazoline (383) 1-[quinolyl-(2)]-3-(4-methoxystyryl)-5-(4-methoxyphenyl)pyrazoline (384) 1-[quinolyl-(2)]-3,5-di-(4-methoxyphenyl)-pyrazoline (385) 1-[quinolyl-(2)]-3-(4-phenoxystyryl)-5-(4-N,N—diethylaminophenyl)pyrazoline (386) 1-[quinolyl-(2)]-3-(4-ethoxystyryl)-5-(4-ethoxyphenyl)pyrazoline (387) 1-[quinolyl-(2)]-3-(4-methoxystyryl)-5-(4-methoxyphenyl)pyrazoline (388) 1-[quinolyl-(2)]-3-(4-methoxystyryl)-5-(4-ethoxyphenyl)pyrazoline (389) 1-[lepidyl-(2)]-3-(4-methoxystyryl)-5-(4-N,N—dimethylaminophenyl)pyrazoline (390) 1-[lepidyl-(2)]-3-(4-methoxystyryl)-5-(4-N,N—diethylaminophenyl)pyrazoline (391) 1-[lepidyl-(2)]-3-(4-methoxystyryl)-5-(4-N,N—dibenzylaminophenyl)pyrazoline (392) 1-[lepidyl-(2)]-3-(4-methoxystyryl)-5-(4-N,N—dipropylaminophenyl)pyrazoline (393) 1-[lepidyl-(2)]-3-(4-methoxystyryl)-5-(4-N—ethyl-N—benzylaminostyryl)pyrazoline (394) 1-[lepidyl-(2)]-3-(4-methoxystyryl)-5-(4-N,N—dibutylaminostyryl)pyrazoline (395) 1-[ lepidyl-(2)]-3-(4-methoxystyryl)-5-(4-methoxyphenyl)pyrazoline (396) 1-[lepidyl-(2)]-3,5-di-(4-methoxyphenyl)pyrazoline (397) 1-[lepidyl-(2)]-3-(4-phenoxystyryl)-5-(4-N,N—diethylaminophenyl)pyrazoline (398) 1-[lepidyl-(2)]-3-(4-ethoxystyryl)-5-(4-ethoxyphenyl)pyrazoline (399) 1-[lepidyl-(2)]-3-(4-methoxystyryl)-5-(4-methoxyphenyl)pyrazoline (400) 1-[lepidyl-(2)]-3-(4-methoxystyryl)-5-(4-ethoxyphenyl)pyrazoline (401) 1-[6-methoxypyridyl-(2)]-3-(4-methoxystyryl)-5-(4-N,N—dimethylaminophenyl)pyrazoline (402) 1-[pyridyl-(2)]-3-(4-methoxystyryl)-5-(4-N,N—diethylaminophenyl)pyrazoline (403) 1-[pyridyl-(2)]-3-(4-methoxystyryl)-5-(4-N,N—dibenzylaminophenyl)pyrazoline (404) 1-[pyridyl-(2)]-3-(4-methoxystyryl)-5-(4-N,N—dipropylaminophenyl)pyrazoline (405) 1-[pyridyl-(2)]-3-(4-methoxystyryl)-5-(4-N—ethyl-N—benzylaminostyryl)pyrazoline (406) 1-[pyridyl-(2)]-3-(4-methoxystyryl)-5-(4-N,N—dibutylaminostyryl)pyrazoline (407) 1-[pyridyl-(2)]-3-(4-methoxystyryl)-5-(4-methoxyphenyl)pyrazoline (408) 1-[pyridyl-(2)]-3,5-di-(4-methoxyphenyl)-pyrazoline (409) 1-[pyridyl-(2)]-3-(4-phenoxystyryl)-5-(4-N,N—diethylaminophenyl)pyrazoline (410) 1-[pyridyl-(2)]-3-(4-ethoxystyryl)-5-(4-ethoxyphenyl)pyrazoline (411) 1-[pyridyl-(2)]-3-(4-methoxystyryl)-5-(4-methoxyphenyl)pyrazoline (412) 1-[pyridyl-(2)]-3-(4-methoxystyryl)-5-(4-ethoxyphenyl)pyrazoline (413) 1-[N—ethyl-carbazolyl-(3)]-3-(4-methoxystyryl)-5-(4-N,N—diethylaminophenyl)pyrazoline (414) 1-[N—ethyl-carbazolyl-(3)]-3-(4-methoxystyryl)-5-(4-methoxyphenyl)pyrazoline These compounds are also readily prepared by known synthetic methods, for instance, by refluxing an unsaturated ketone and a hydrazino compound represented by the following formulae (i) and (j), respectively, in alcohol in the presence of a small amount of acetic acid for several hours.

Formula (i) $R_2-CH=CH-\underset{\underset{O}{\|}}{C}-(\underset{\underset{H}{|}}{C}=CH)_n-R_1$ (j) $X_1-NH-NH_2$ ($R_1$, $R_2$, $X_1$, and n are as defined above)

(415) 1-[pyridyl-(3)]-3,5-di-(4-N,N—dimethylaminostyryl)pyrazoline (416) 1-[pyridyl-(3)]-3,5-di-(4-N,N—diethylaminostyryl)pyrazoline (417) 1-[pyridyl-(3)]-3,5-di-(4-N,N—dibenzylaminostyryl)pyrazoline (418) 1-[pyridyl-(3)]-3,5-di-(4-N,N—dipropyl- -continued aminostyryl)pyrazoline (419) 1-[pyridyl-(3)]-3,5-di-(4-N,N—dibutyl-aminostyryl)pyrazoline (420) 1-[pyridyl-(3)]-3-(4-N,N—diethylamino-styryl)-5-(4-N,N—dibenzylaminostyryl)pyrazoline (421) 1-[pyridyl-(3)]-3-(α-methyl-4-N,N—diethylaminostyryl)-5-(4-N,N—diethylaminostyryl)-pyrazoline (422) 1-[pyridyl-(3)]-3-(α-benzyl-4-N,N—diethylaminostyryl)-5-(4-N,N—diethylaminostyryl)-pyrazoline (423) 1-[pyridyl-(3)]-3-(α-phenyl-4-N,N—diethylaminostyryl)-5-(4-N,N—diethylaminostyryl)-pyrazoline (424) 1-[pyridyl-(3)]-3,5-di-(4-N,N—diethylaminostyryl)-4-methylpyrazoline (425) 1-[pyridyl-(3)]-3,5-di-(4-N,N—diethylaminostyryl)-4-benzylpyrazoline (426) 1-[pyridyl-(3)]-3,5-di-(4-N,N—diethylaminostyryl)-4-phenylpyrazoline (427) 1-[pyridyl-(3)]-3-(4-N,N—diethylamino-phenyl)-4-methyl-5-(4-N,N—diethylaminostyryl)pyrazoline (428) 1-[pyridyl-(3)]-3-[β-(2-furyl)vinyl]-5-(4-N,N—diethylaminostyryl)pyrazoline (429) 1-[pyridyl-(3)]-3-[β-(N—ethyl-4-imidazolyl)vinyl]-5-(4-N,N—diethylaminostyryl)-pyrazoline (430) 1-[pyridyl-(3)]-3-[β-(N—ethyl-3-carbazolyl)vinyl]-5-(4-N,N—diethylaminostyryl)-pyrazoline (431) 1-[pyridyl-(3)]-3-(4-N,N—diethyl-aminostyryl)-5-[β-(2-furyl)vinyl]pyrazoline (432) 1-[pyridyl-(3)]-3-(4-N,N—diethyl-aminostyryl)-5-[β-(N—ethyl-4-imidazolyl)vinyl]-pyrazoline (433) 1-[pyridyl-(3)]-3-(4-N,N—diethyl-aminostyryl)-5-[β-(N—ethyl-4-oxazolyl)vinyl] -pyrazoline (434) 1-[pyridyl-(3)]-3,5-di-[β-(2-furyl)-vinyl]pyrazoline (435) 1-[pyridyl-(3)]-3,5-di-(4-methoxystyryl)-pyrazoline (436) 1-[quinolyl-(2)]-3,5-di-(4-N,N—dimethylaminostyryl)pyrazoline (437) 1-[quinolyl-(2)]-3,5-di-(4-N,N—diethylaminostyryl)pyrazoline (438) 1-[quinolyl-(2)]-3,5-di-(4-N,N—dibenzylaminostyryl)pyrazoline (439) 1-[quinolyl-(2)]-3,5-di-(4-N,N—dipropylaminostyryl)pyrazoline (440) 1-[quinolyl-(2)]-3,5-di-(4-N,N—dibutylaminostyryl)pyrazoline (441) 1-[quinolyl-(2)]-3-(4-N,N—diethylamino-styryl)-5-(4-N,N—dibenzylaminostyryl)pyrazoline (442) 1-[quinolyl-(2)]-3-(α-methyl-4-N,N—diethylaminostyryl)-5-(4-N,N—diethylaminostyryl)-pyrazoline (443) 1-[quinolyl-(2)]-3-(α-benzyl-4-N,N—diethylaminostyryl)-5-(4-N,N—diethylaminostyryl)-pyrazoline (444) 1-[quinolyl-(2)]-3-(α-phenyl-4-N,N—diethylaminostyryl)-5-(4-N,N—diethylaminostyryl)-pyrazoline (445) 1-[quinolyl-(2)]-3,5-di-(4-N,N—diethylaminostyryl)-4-methylpyrazoline (446) 1-[quinolyl-(2)]-3,5-di-(4-N,N—diethylaminostyryl)-4-benzylpyrazoline (447) 1-[quinolyl-(2)]-3,5-di-(4-N,N—diethylaminostyryl)-4-phenylpyrazoline (448) 1-[quinolyl-(2)]-3-(4-N,N—diethylamino-phenyl)-4-methyl-5-(4-N,N—diethylaminostyryl)pyrazoline (449) 1-[quinolyl-(2)]-3-[β-(2-furyl)vinyl]-5-(4-N,N—diethylaminostyryl)pyrazoline (450) 1-[quinolyl-(2)]-3-[β-(N—ethyl-4-imidazolyl)vinyl]-5-(4-N,N—diethylaminostyryl)-pyrazoline (451) 1-[quinolyl-(2)]-3-[β-(N—ethyl-3-carbazolyl)vinyl]-5-(4-N,N—diethylaminostyryl)-pyrazoline (452) 1-[quinolyl-(2)]-3-(4-N,N—diethylamino-styryl-5-[β-(2-furyl)vinyl]pyrazoline (453) 1-[quinolyl-(2)]-3-(4-N,N—diethylamino-styryl)-5-[ β-(N—ethyl-4-imidazolyl)vinyl]pyrazoline (454) 1-[quinolyl-(2)]-3-(4-N,N—diethylamino-styryl)-5-[β(N—ethyl-4-oxazolyl)vinyl]pyrazoline (455) 1-[quinolyl-(2)]-3,5-di-[β-(2-furyl)-vinyl]pyrazoline (456) 1-[quinolyl-(2)]-3,5-di-(4-methoxy-styryl)pyrazoline (457) 1-[lepidyl-(2)]-3,5-di-(4-N,N—dimethylaminostyryl)pyrazoline (458) 1-[lepidyl-(2)]-3,5-di-(4-N,N—diethylaminostyryl)pyrazoline (459) 1-[lepidyl-(2)]-3,5-di-(4-N,N—dibenzylaminostyryl)pyrazoline (460) 1-[lepidyl-(2)]-3,5-di-(4-N,N—dipropylaminostyryl)pyrazoline (461) 1-[lepidyl-(2)]-3,5-di-(4-N,N—dibutylaminostyryl)pyrazoline (462) 1-[lepidyl-(2)]-3-(4-N,N—diethylamino-styryl)-5-(4-N,N—dibenzylaminostyryl)pyrazoline (463) 1-[lepidyl-(2)]-3-(α-methyl-4-N,N—diethylaminostyryl)-5-(4-N,N—diethylaminostyryl)-pyrazoline (464) 1-[lepidyl-(2)]-3-(α-benzyl-4-N,N—diethylaminostyryl)-5-(4-N,N—diethylaminostyryl)-pyrazoline (465) 1-[lepidyl-(2)]-3-(α-phenyl-4-N,N—diethylaminostyryl)-5-(4-N,N—diethylaminostyryl)-pyrazoline (466) [lepidyl-(2)]-3,5-di-(4-N,N—diethylaminostyryl)-4-methylpyrazoline (467) 1-[lepidyl-(2)]-3,5-di-(4-N,N—diethylaminostyryl)-4-benzylpyrazoline (468) 1-[lepidyl-(2)]-3,5-di-(4-N,N—diethylaminostyryl)-4-phenylpyrazoline (469) 1-[lepidyl-(2)]-3-(4-N,N—diethylamino-phenyl)-4-methyl-5-(4-N,N—diethylaminostyryl)pyrazoline (470) 1-[lepidyl-(2)]-3-[β-(2-furyl)vinyl]-5-(4-N,N—diethylaminostyryl)pyrazoline (471) 1-[lepidyl-(2)]-3-[β-(N—ethyl-4-imidazolyl)vinyl]-5-(4-N,N—diethylaminostyryl)-pyrazoline (472) 1-[lepidyl-(2)]-3-[β-(N—ethyl-3-carbazolyl)vinyl]-5-(4-N,N—diethylaminostyryl)-pyrazoline (473) 1-[lepidyl-(2)]-3-(4-N,N— diethylamino-styryl)-5-[β-(2-furyl)vinyl]pyrazoline (474) 1-[lepidyl-(2)]-3-(4-N,N—diethylamino-styryl)-5-[β-(N—ethyl-4-imidazolyl)vinyl]pyrazoline (475) 1-[lepidyl-(2)]-3-(4-N,N—diethylamino-styryl)-5-[β-(N—ethyl-4-oxazolyl)vinyl]pyrazoline (476) 1-[lepidyl-(2)]-3,5-di-[β-(2-furyl)vinyl]-pyrazoline (477) 1-[lepidyl-(2)]-3,5-di-(4-methoxystyryl)-pyrazoline (478) 1-[pyridyl-(2)]-3,5-di-(4-N,N—dimethylaminostyryl)pyrazoline (479) 1-[pyridyl-(2)]-3,5-di-(4-N,N—diethylaminostyryl)pyrazoline (480) 1-[pyridyl-(2)]-3,5-di-(4-N,N—dibenzylaminostyryl)pyrazoline (481) 1-[pyridyl-(2)]-3,5-di-(4-N,N—dipropylaminostyryl)pyrazoline (482) 1-[pyridyl-(2)]-3,5-di-(4-N,N—dibutylaminostyryl)pyrazoline (483) 1-[pyridyl-(2)]-3-(4-N,N—diethylamino-styryl)-5-(4-N,N—dibenzylaminostyryl)pyrazoline (484) 1-[pyridyl-(2)]-3-(α-methyl-4-N,N—diethylaminostyryl)-5-(4-N,N—diethylaminostyryl)-pyrazoline (485) 1-[pyridyl-(2)]-3-(α-benzyl-4-N,N—diethylaminostyryl)-5-(4-N,N—diethylaminostyryl)-pyrazoline (486) 1-[pyridyl-(2)]-3-(α-phenyl-4-N,N—diethylaminostyryl)-5-(4-N,N—diethylaminostyryl)-pyrazoline (487) 1-[pyridyl-(2)]-3,5-di-(4-N,N—diethylaminostyryl)-4-methylpyrazoline (488) 1-[pyridyl-(2)]-3,5-di-(4-N,N—diethylaminostyryl)-4-benzylpyrazoline (489) 1-[pyridyl-(2)]-3,5-di-(4-N,N—diethylaminostyryl)-4-phenylpyrazoline (490) 1-[pyridyl-(2)]-3-(4-N,N—

-continued diethylaminophenyl)-4-methyl-5-(4-N,N—diethylaminostyryl)pyrazoline (491) 1-[pyridyl-(2)]-3-[β-(2-furyl)vinyl]-5-(4-N,N—diethylaminostyryl)pyrazoline (492) 1-[pyridyl-(2)]-3-[β-(N—ethyl-4-imidazolyl)vinyl]-5-(4-N,N—diethylaminostyryl)-pyrazoline (493) 1-[pyridyl-(2)] -3-[β-(N—ethyl-3-carbazolyl)vinyl]-5-(4-N,N—diethylaminostyryl)-pyrazoline (494) 1-[pyridyl-(2)]-3-(4-N,N—diethylamino-styryl)-5-[β-(2-furyl)vinyl]pyrazoline (495) 1-[pyridyl-(2)]-3-(4-N,N—diethylamino-styryl)-5-[β-(N—ethyl-4-imidazolyl)vinyl]pyrazoline (496) 1-[pyridyl-(2)]-3-(4-N,N—diethylamino-styryl)-5-[β-(N—ethyl-4-oxazolyl)vinyl]pyrazoline (497) 1-[pyridyl-(2)]-3,5-di-[β-(2-furyl)vinyl]-pyrazoline (498) 1-[pyridyl-(2)]-3,5-di-(4-methoxystyryl)-pyrazoline (499) 1-[N—ethyl-carbazolyl-(3)]-3,5-di-(4-N,N—diethylaminostyryl)pyrazoline (500) 1-[N—ethyl-carbazolyl-(3)]-3,5-di-(4-N,N—diethylaminostyryl)-4-methylpyrazoline (501) 1-[6-methoxypyridyl-(2)]-3,5-di-(4-morpholinostyryl)pyrazoline (502) 1-[6-methoxypyridyl-(2)]-3,5-di-(4-pyrrolidinostyryl)pyrazoline These compounds are readily prepared by known synthetic methods, for instance, by refluxing an unsaturated ketone and a hydrazino compound represented by the following formulae (k) and (l), respectively, in alcohol in the presence of a small amount of acetic acid for several hours.

Formula (k) $R_2-CH=CH-CH=C(R_5)-C(=O)-(C(R_4)=CH)_n-R_1$ (l) $X_1-NH-NH_2$ ($R_1$, $R_2$, $R_4$, $R_5$, $X_1$, and n are as defined above)

(503)

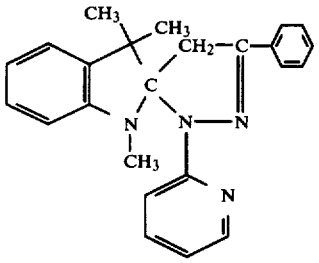

(504)

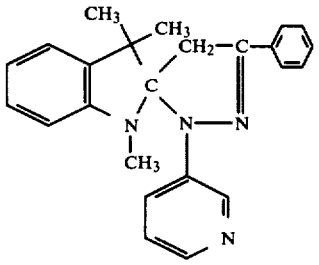

-continued (505)

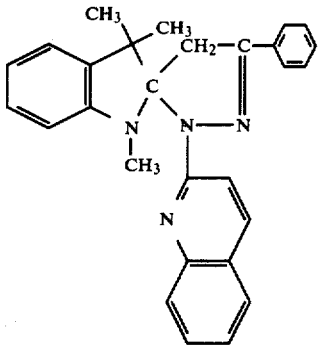

(506)

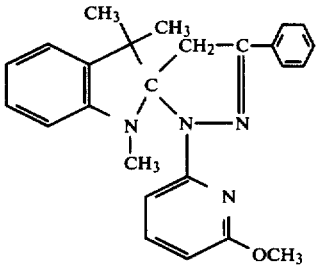

(507)

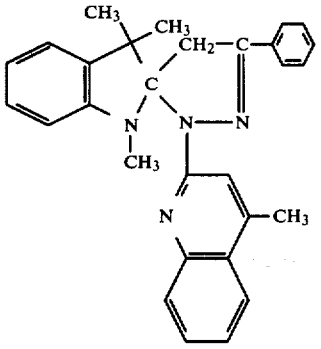

(508)

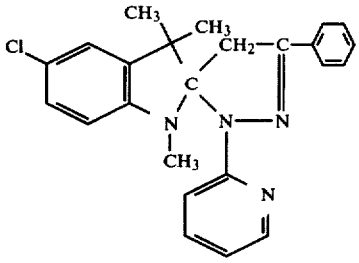

(509)

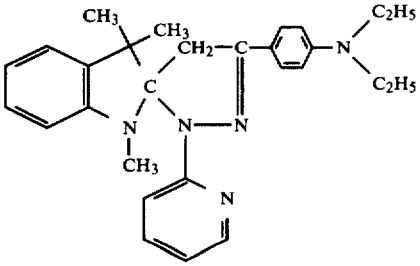

-continued
(510)
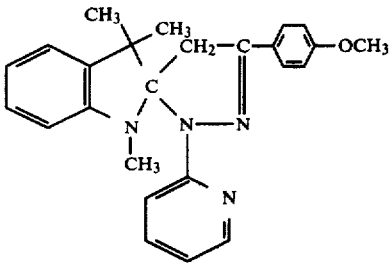
(511)
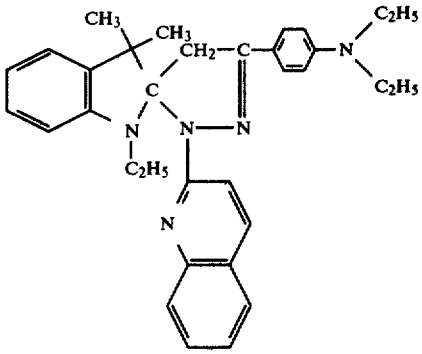
(512)
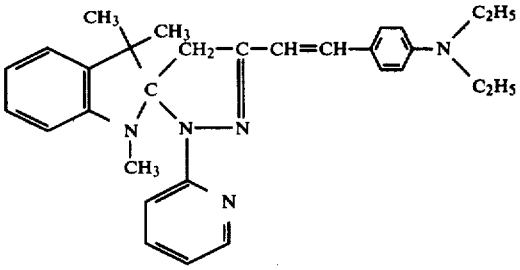
(513)
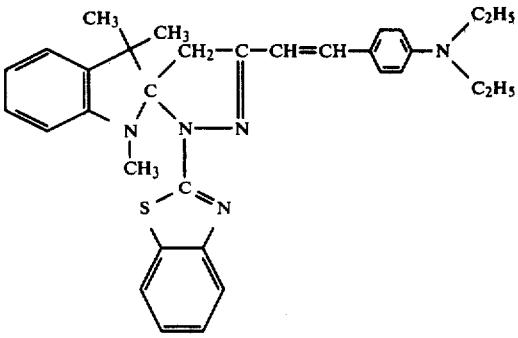
(514)
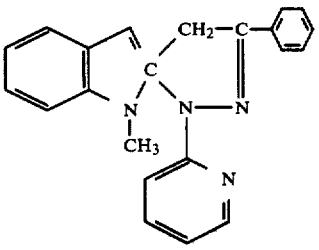
-continued
(515)
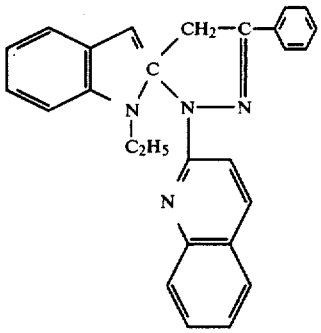
(516)
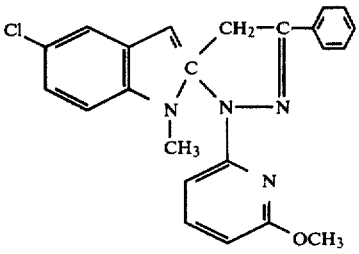
(517)
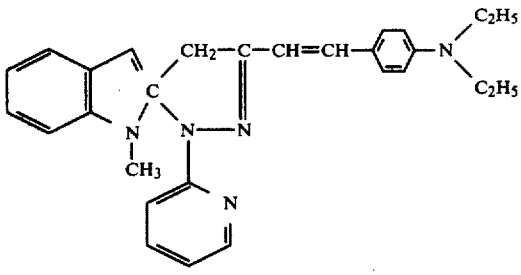
(518)
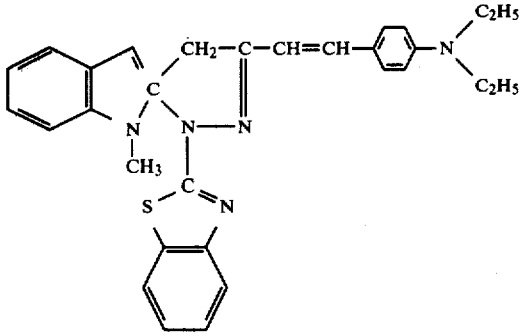
(519)
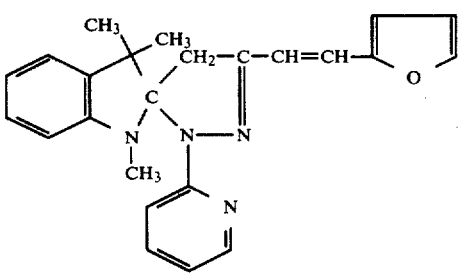

-continued
(520)
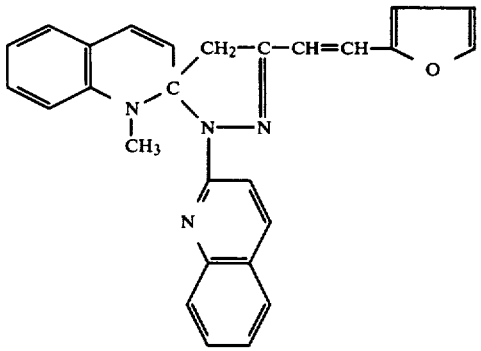
(521)
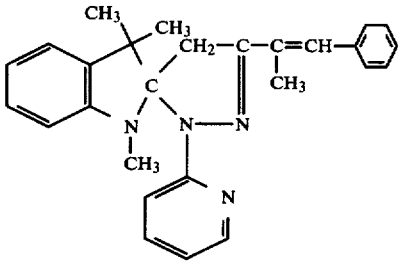
(522)
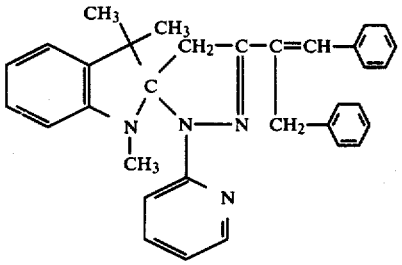
These compounds are readily prepared by ring closure of compounds represented by the following formurae (m) and (n) by, for example, the method disclosed in Japanese Patent Kokai No. 26761(1973).
Formula
(m)
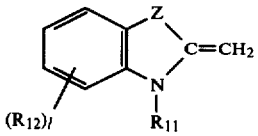
(n) $X_1-NH-N=C(Y)-C(R_4)=CH)_n R_1$
($R_1$, $R_4$, $R_{11}$, $R_{12}$, $X_1$, l, Z, and n are as defined above, and Y is an acidic residue.)
(523)
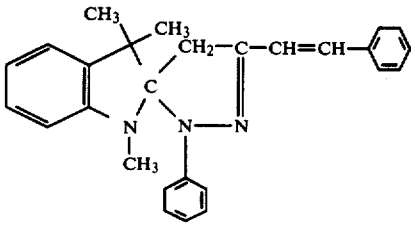
-continued
(524)
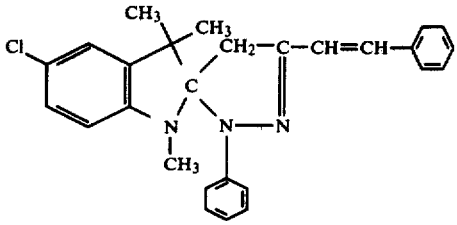
(525)
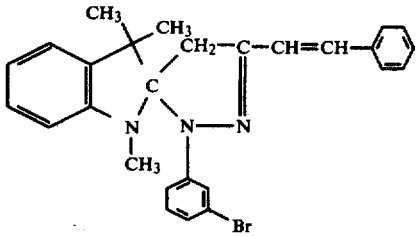
(526)
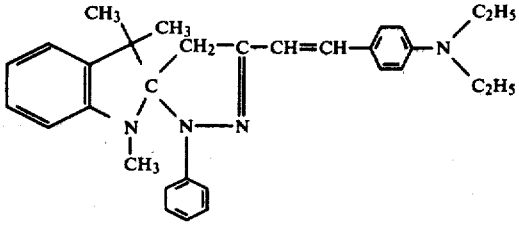
(527)
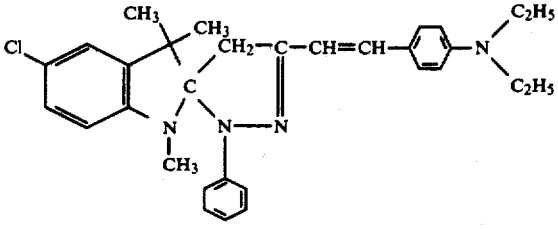
(528)
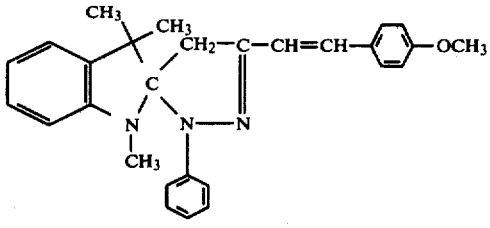
(529)
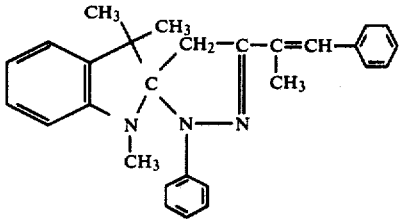

-continued
(530)
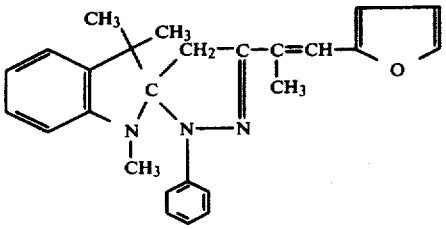
(531)
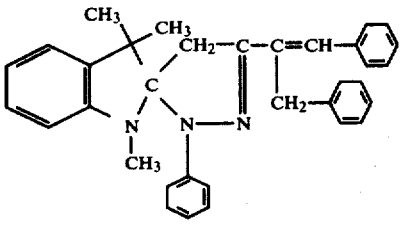
(532)
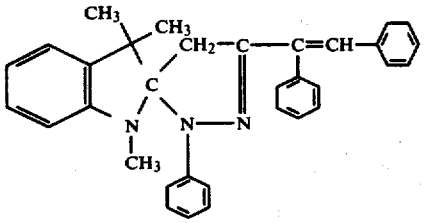
(533)
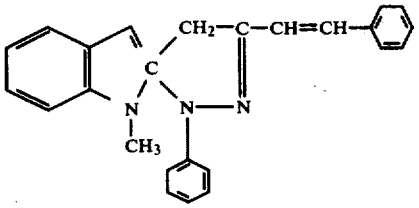
(534)
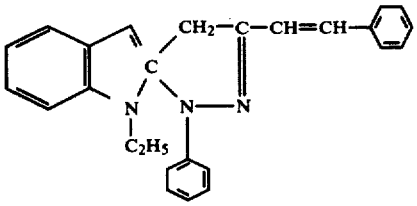
-continued
(535)
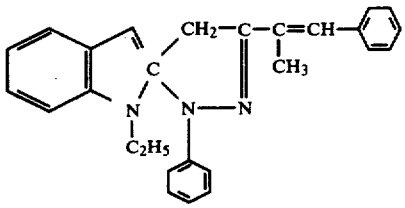
(536)
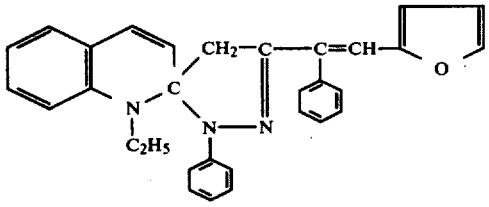
(537)
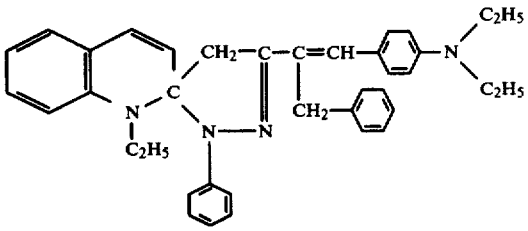
These compounds are readily prepared by ring closure of compounds represented by the following formulae (o) and (p) by, for example, the method disclosed in Japanese Patent Kokai No. 26761(1973).
Formula
(o)
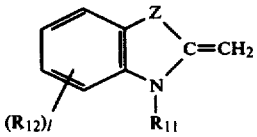
(p) $X_1-NH-N=\underset{Y}{C}-\underset{R_4}{C}=CH-R_1$
($R_1$, $R_4$, $R_{11}$, $R_{12}$, $X_1$, $Z_1$ and l are as defined above, and Y is an acidic residue.)
(538)
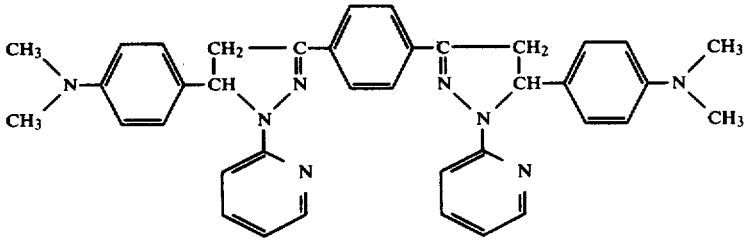

-continued
(539)
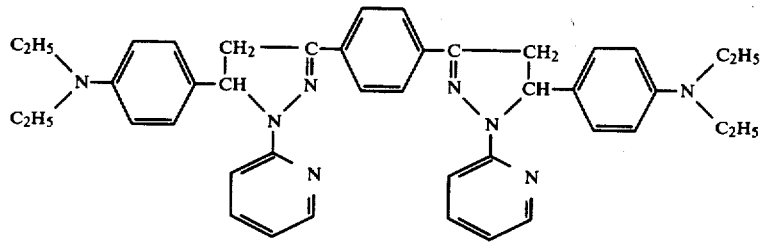
(540)
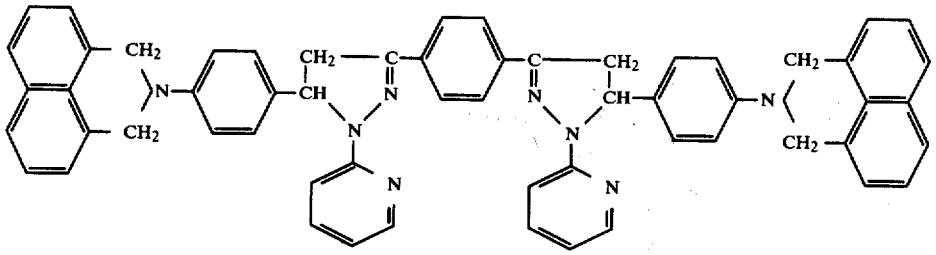
(541)
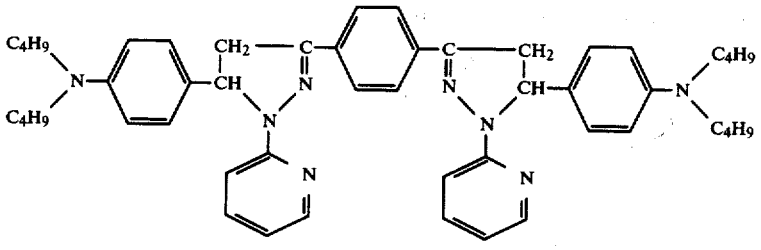
(542)
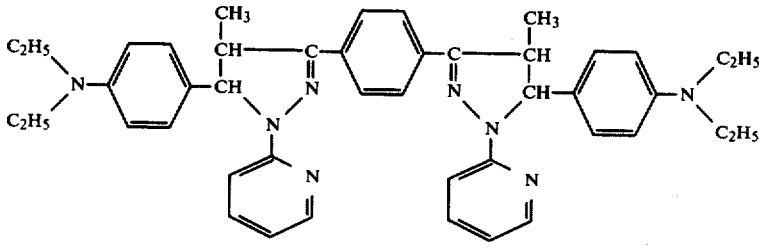
(543)
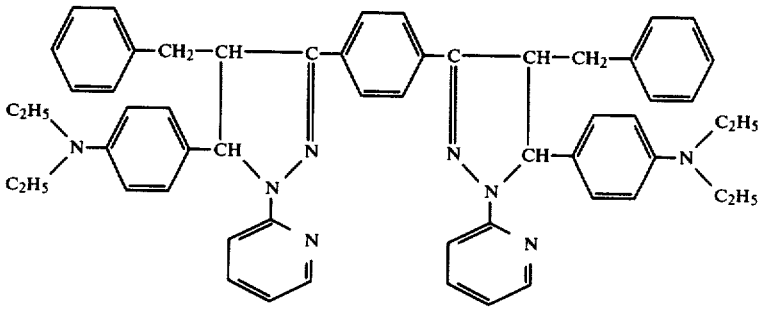

-continued
(544)
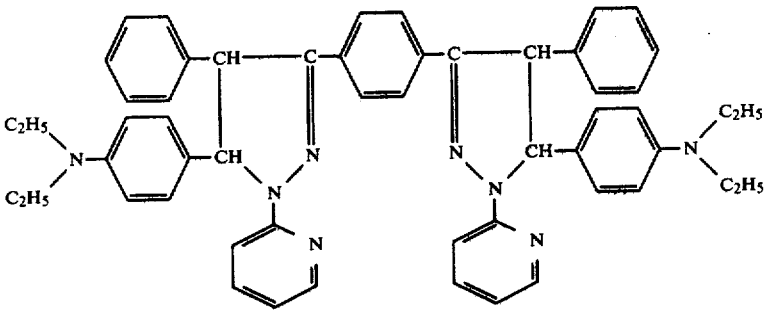
(545)
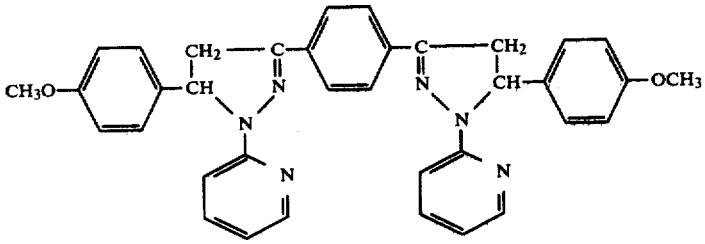
(546)
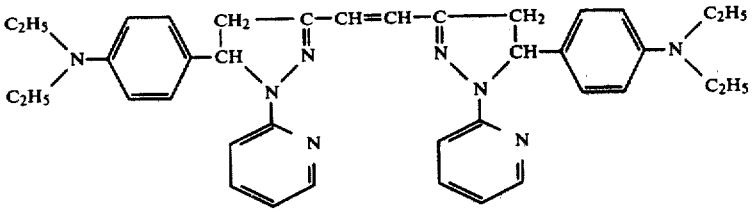
(547)
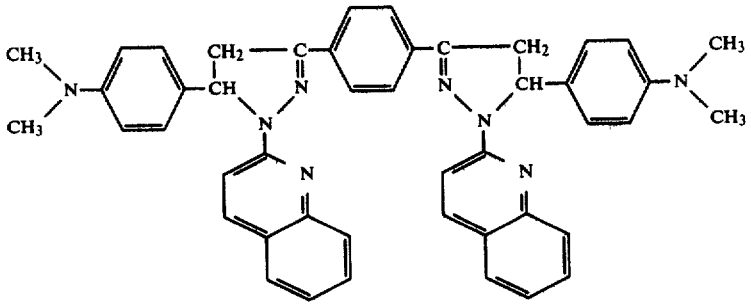
(548)
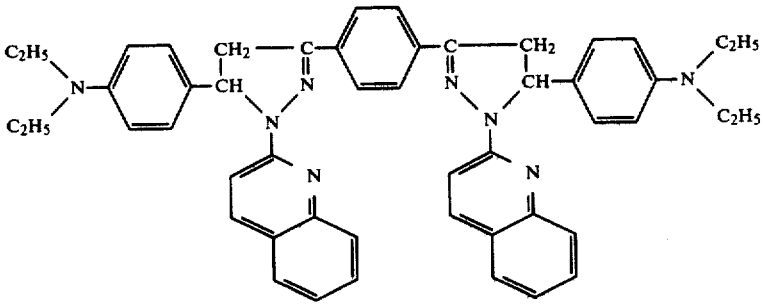

-continued
(549)
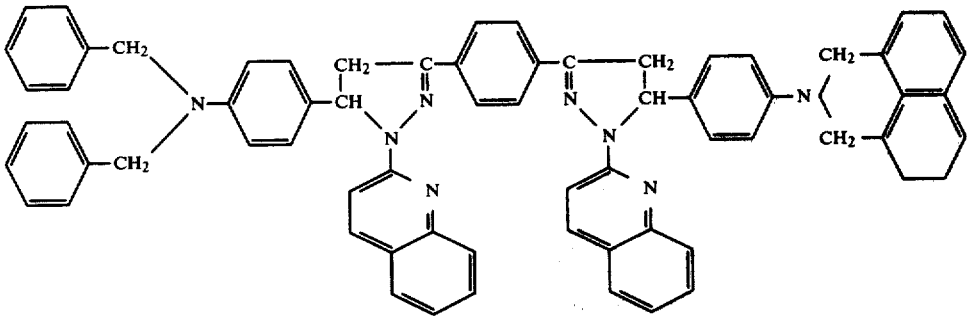
(550)
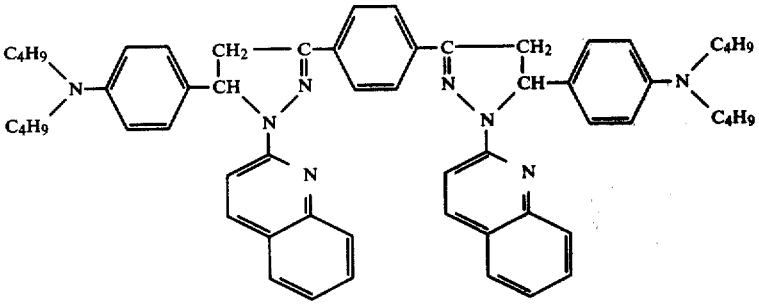
(551)
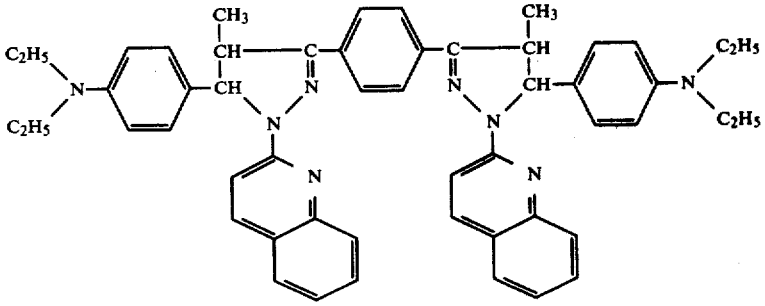
(552)
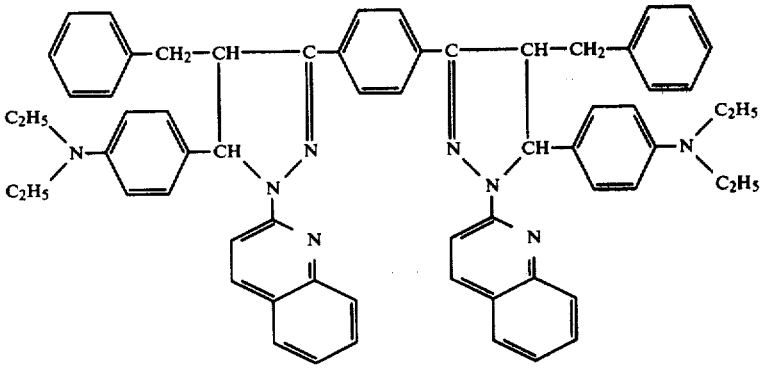

-continued
(553)
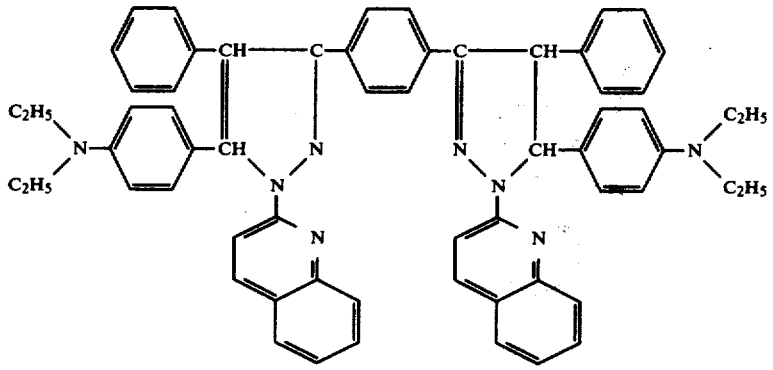
(554)
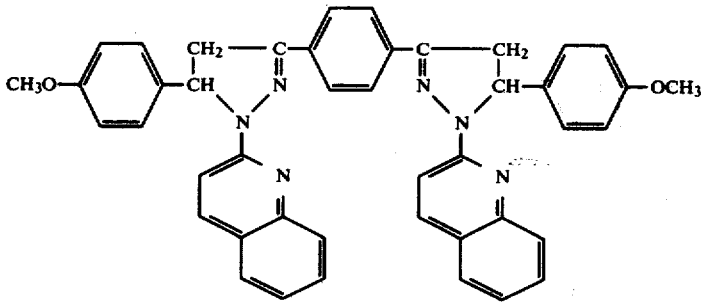
(555)
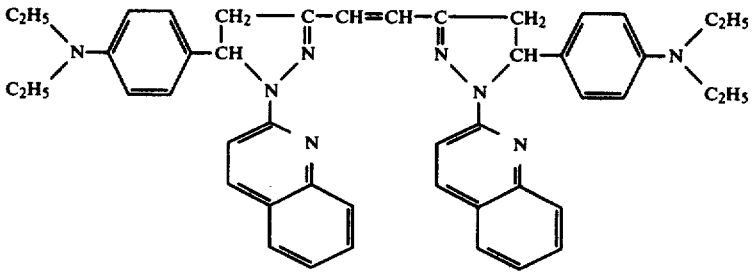
(556)
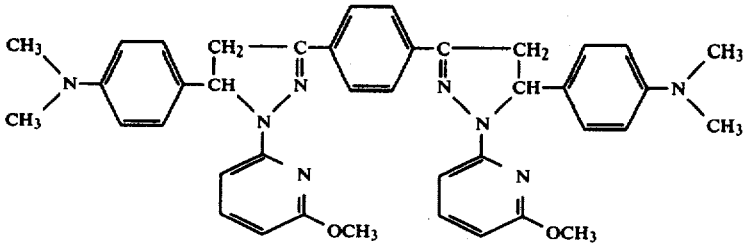
(557)
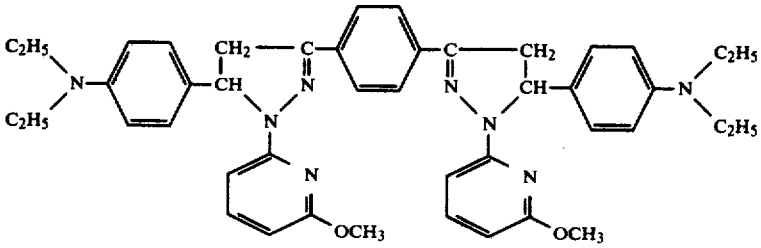

-continued
(558)
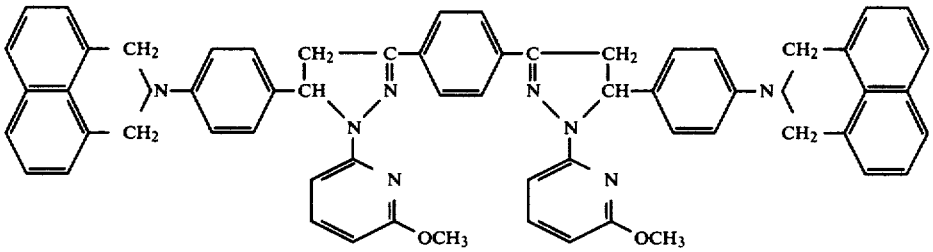
(559)
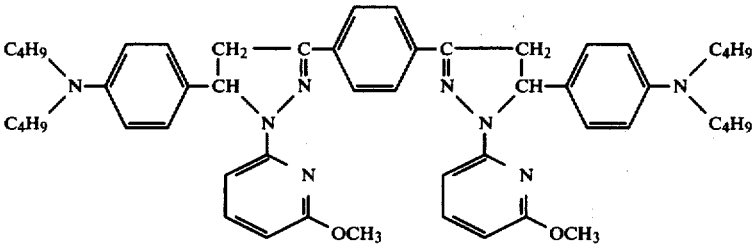
(560)
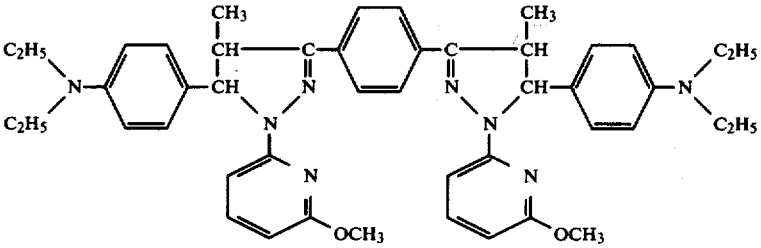
(561)
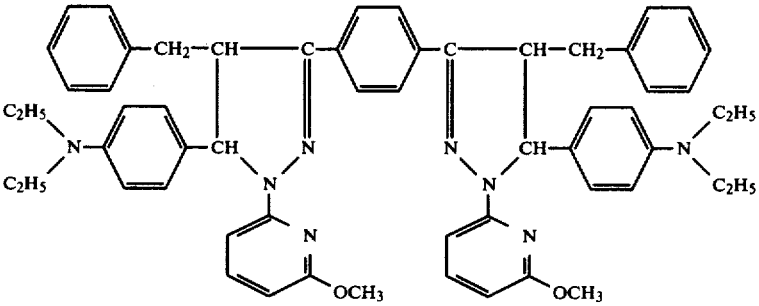
(562)
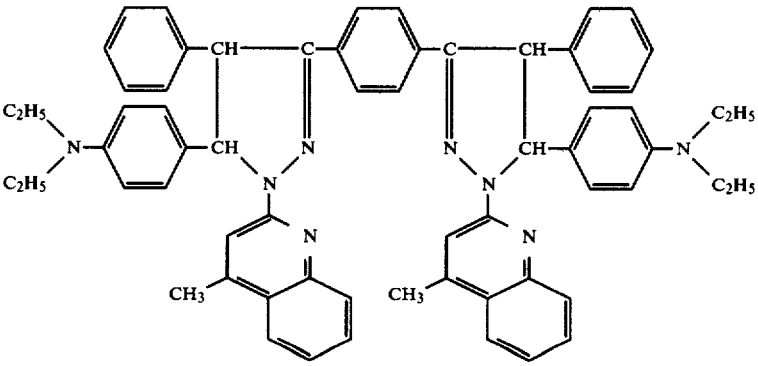

-continued
(563)
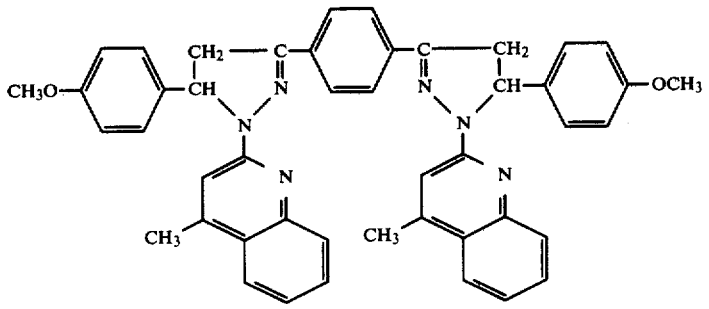
(564)
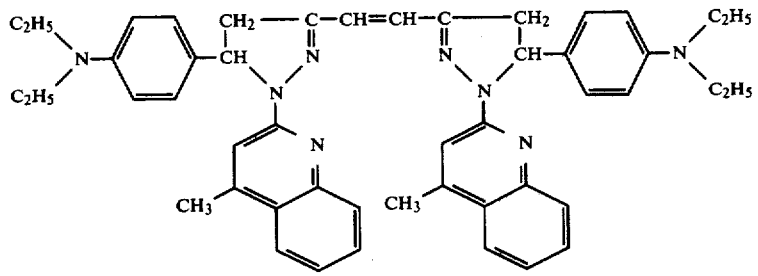
(565)
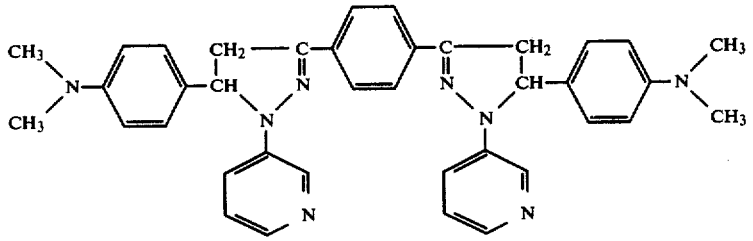
(566)
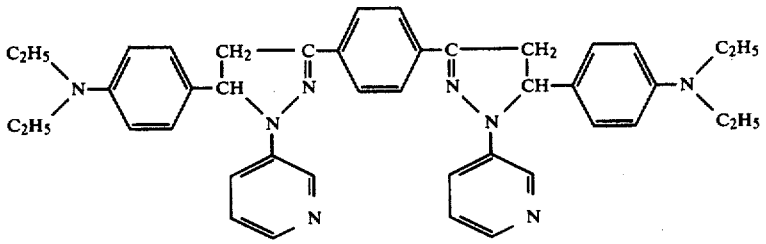
(567)
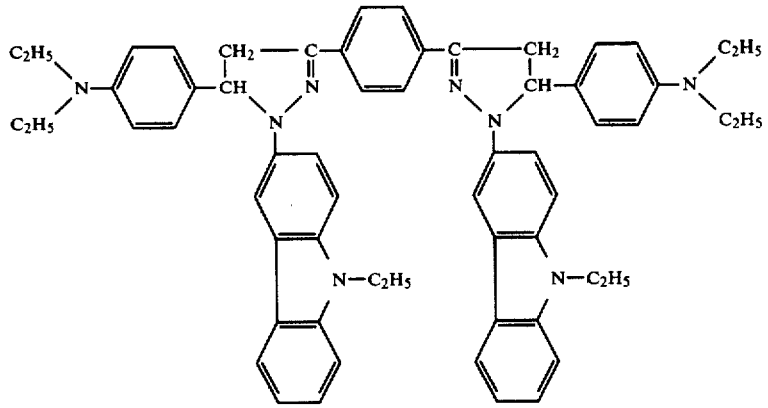
These compounds are readily prepared by known methods, for instance, by refluxing an unsaturated ketone and a hydrazino compound represented by the following formulae (q) and (r), respectively, in alcohol in the presence a small amount of acetic acid for several hours:
Formula -continued

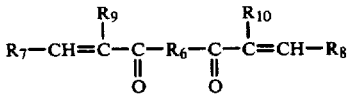

(q)

$X_2—NH—NH_2$ (r)

wherein $R_6$, $R_7$, $R_8$, $R_9$, $R_{10}$, and $X_2$ are as defined above, and $X_2$ and $X_3$ are the same.

The pyrazoline, spiropyrazoline, and bispyrazoline compounds cited above may be used singly or in combination.

In preferred embodiments of the electrophotographic photosensitive member of this invention, laminated photosensitive layers are used which comprises a charge transport layer containing the foregoing pyrazoline compound as a charge-transporting material and a charge generation layer, which will be explained later.

The charge transport layer is preferably formed by coating and drying a solution prepared by dissolving said pyrazoline compound and a binder in a suitable solvent. Binders herein used include, for example, acrylic resins, methacrylic resins, vinyl chloride resin, vinyl acetate resin, phenolic resins, epoxy resins, polyester resins, polysulfone, alkyd resins, polycarbonates, polyurethanes, and copolymer resins containing two or more types of repeating units of these resins, among which polyester resins and polycarbonates are particularly preferred. Photoconductive polymers like poly(N-vinylcarbazole) can also be used as the binder which have a charge-transporting function per se.

Suitable compounding ratios of the charge-transporting compound to the binder are 10–500:100 by weight. Thickness of the charge transport layer is 2 to 100μ, preferably 5–30μ.

Solvents for the coating solution used for forming the charge transport layer include a number of useful organic solvents conventionally used. Typical examples thereof are aromatic hydrocarbons and their halogen derivatives such as benzene, toluene, xylene, and chlorobenzene; ketones such as acetone and 2-butanone; halogenated aliphatic hydrocarbons such as methylene chloride, chloroform, and ethylene chloride; cyclic or linear ethers such as tetrahydrofuran and ethyl ether; and mixtures of these solvents.

Various additives can be incorporated into the charge transport layer of this invention. Such additives include diphenyl, chlorodiphenyl, o-terphenyl, p-terphenyl, dibutyl phthalate, dimethyl glycol phthalate, dioctyl phthalate, triphenyl phosphate, methylnaphthalene, benzophenone, chlorinated paraffin, dilaury thiopropionate, 3,5-dinitrosalicylic acid, various kinds of fluorocarbons, silicone oils, etc.

For the charge-generation layer, any charge-generating material can be used so far as it, on absorbing light, generates charge carriers in a very high efficiency. Preferred charge-generating materials in this invention are inorganic substances including seleniun, selenium-tellulium, selenium-arsenic, cadmium sulfide, and amorphous silicon and organic substances including pyrylium dyes, thiopyrylium dyes, triarylmethane dyes, thiazine dyes, cyanine dyes, phthalocyanine pigments, perylene pigments, indigo pigments, thioindigo pigments, quinacridone pigments, squaric acid pigments, azo pigments, polycyclic quinone pigments, and the like. Thickness of the charge generation layer is up to 5μ, preferably 0.05 to 3μ.

The charge generation layer is formed in an appropriate way such as vacuum deposition, sputtering, glow discharge, usual coating, and the like, to meet the nature of charge-generating material used.

Charge-generating materials are applied to coating without any binder or in the form of dispersion in a binder solution or in the form of homogeneous solution along with a binder. In the above cases, the binder content in the charge generation layer should be up to 80%, preferably up to 40%, since excessive contents of binder adversely affect the sensitivity.

Binders available for the charge generation layer include poly(vinyl butyral), poly(methyl methacrylate), polyesters, poly(vinylidene chloride), chlorinated rubbers, polyvinyltoluene, styrene-maleic anhydride copolymer, polystyrene, poly(vinyl chloride), methylcellulose, polyamides, polyvinylpyridine, styrene-butadene copolymer, etc.

The following compounds can be used as the charge generating material for the electrophotographic photosensitive member of this invention.

Charge generating materials

Amphorous silicon
Selenium-Tellurium
Selemium-Arsenic

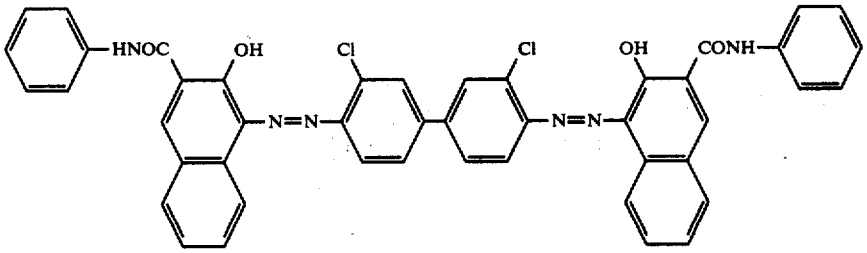

-continued
Charge generating materials
(5)
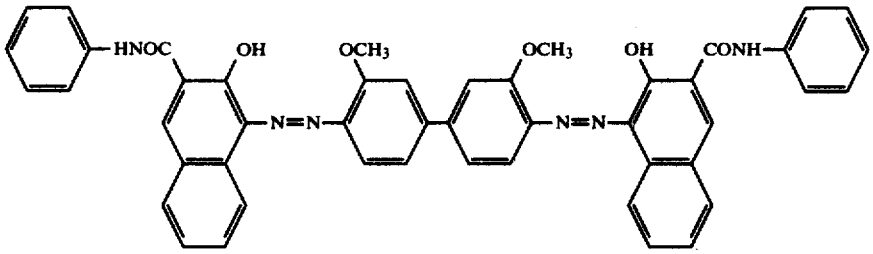
(6)
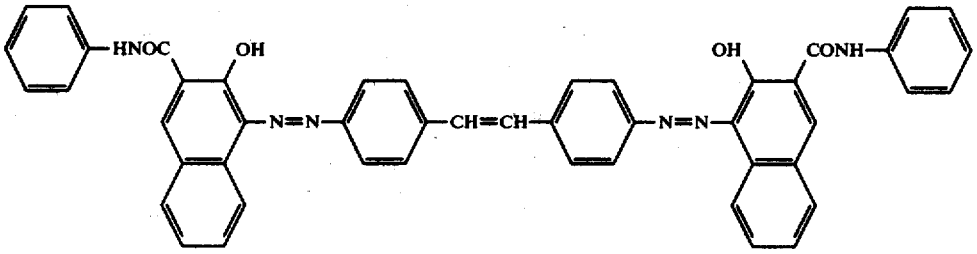
(7)
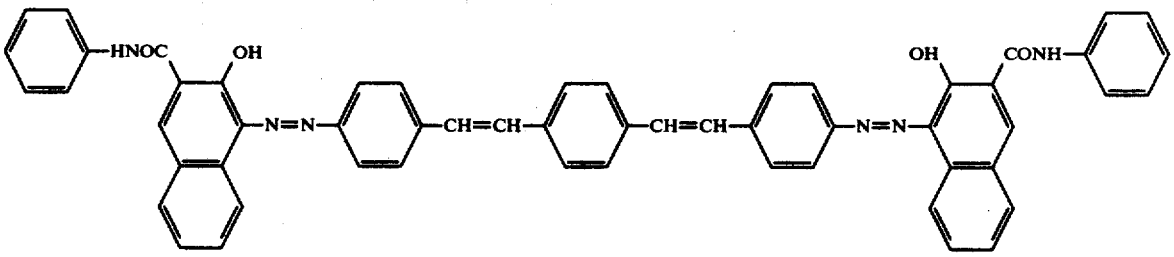
(8)
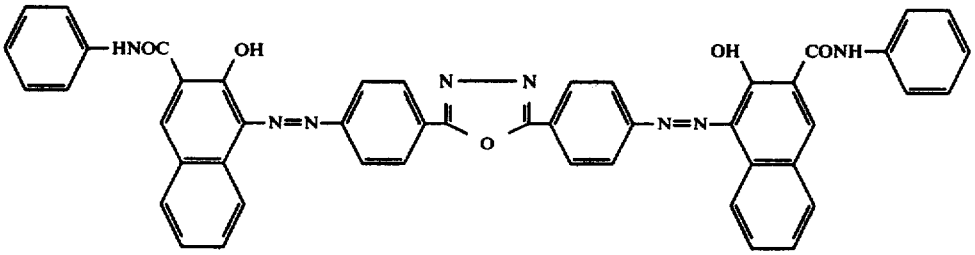
(9)
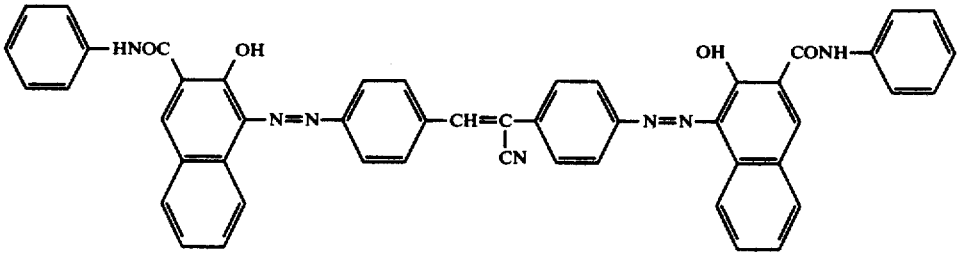

-continued
Charge generating materials
(10)
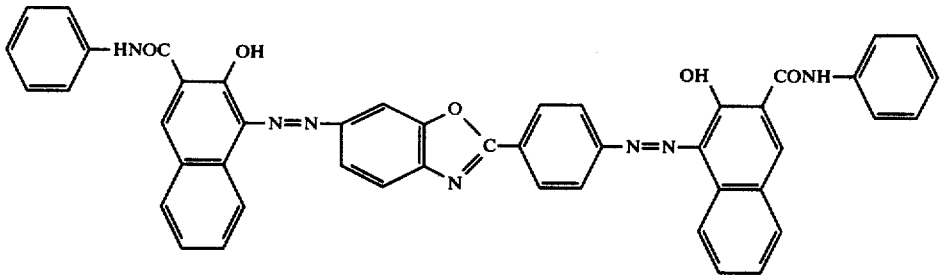
(11)
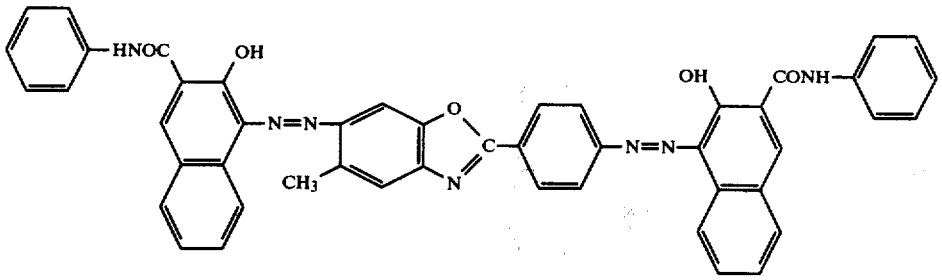
(12)
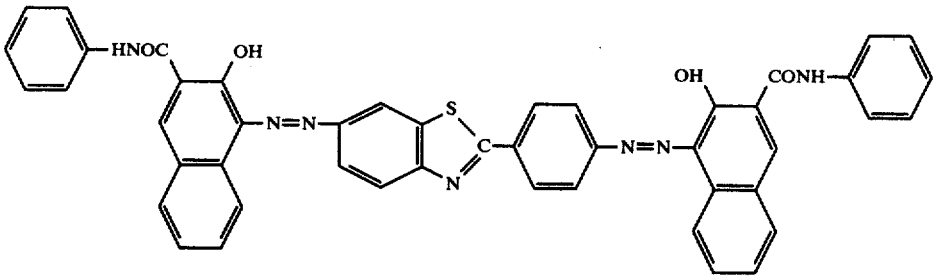
(13)
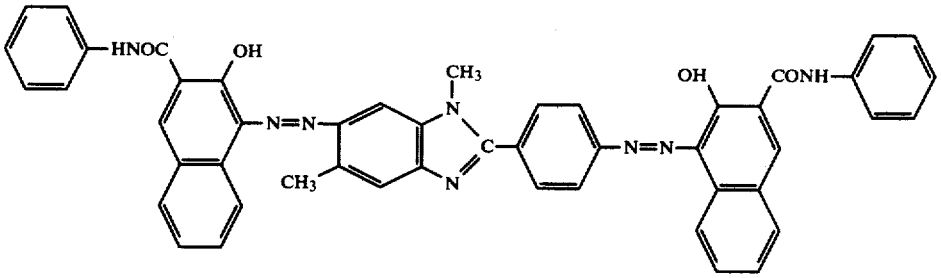
(14)
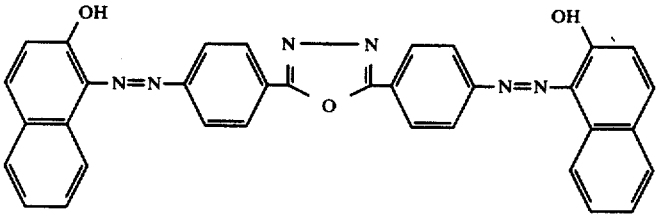
(15)
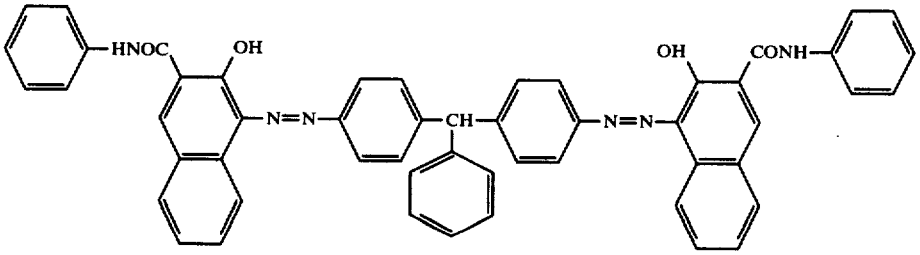

-continued
Charge generating materials
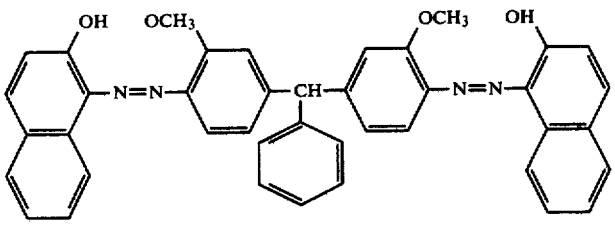
(16)
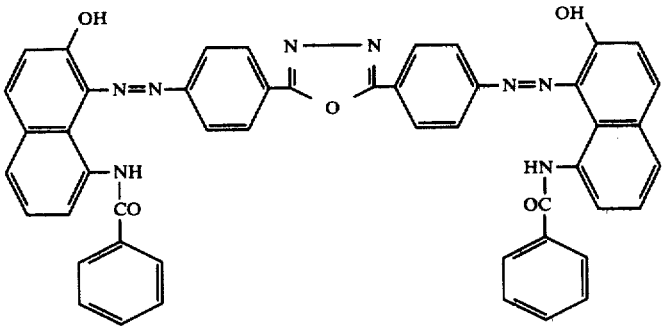
(17)
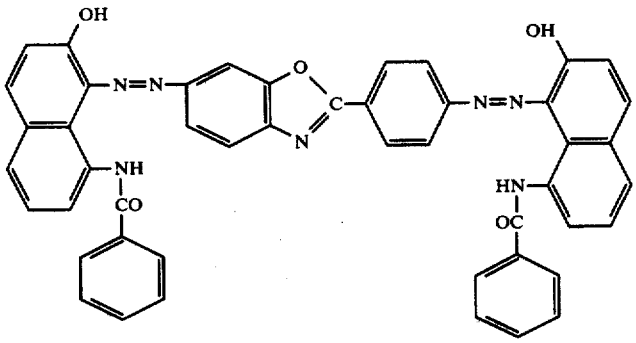
(18)
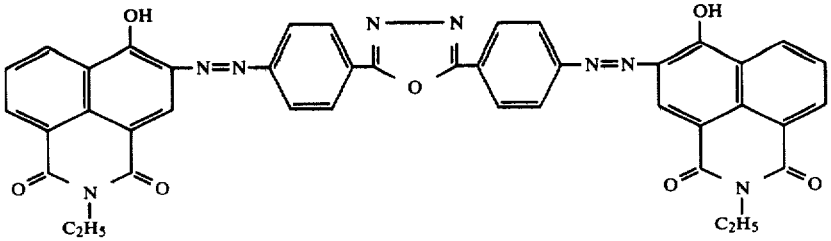
(19)
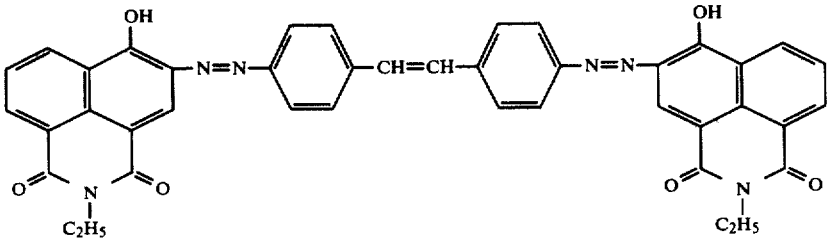
(20)

-continued
Charge generating materials
(21)
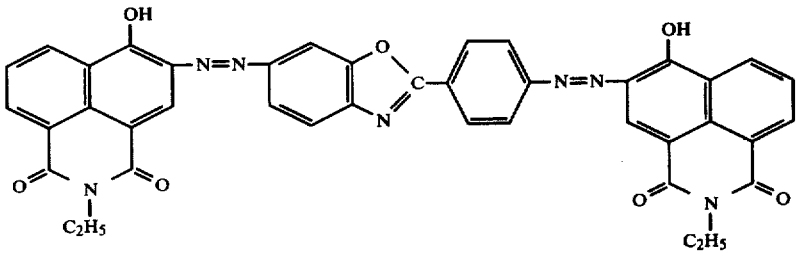
(22)
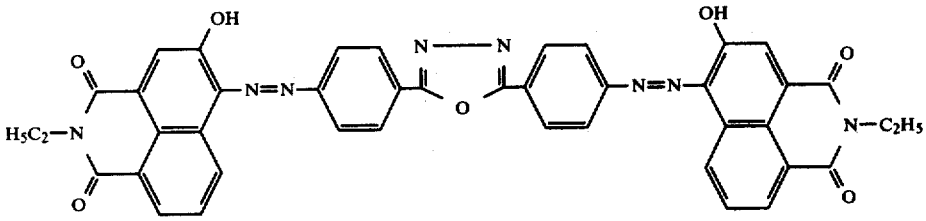
(23)
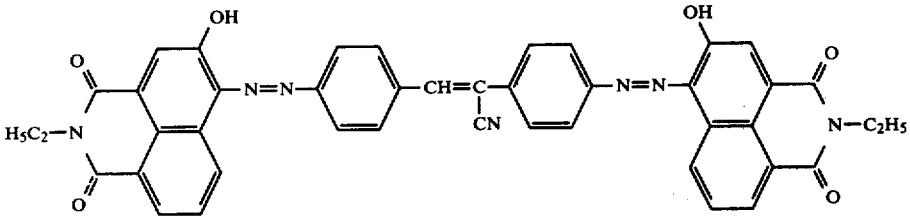
(24)
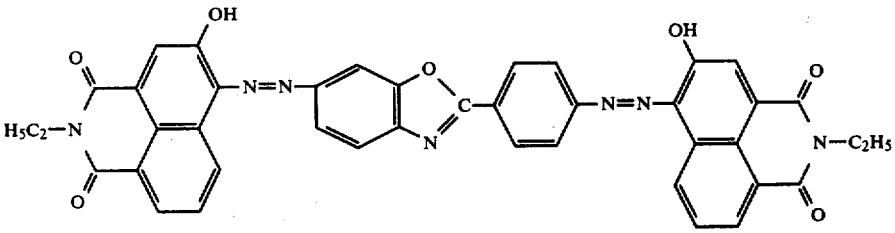
(25)
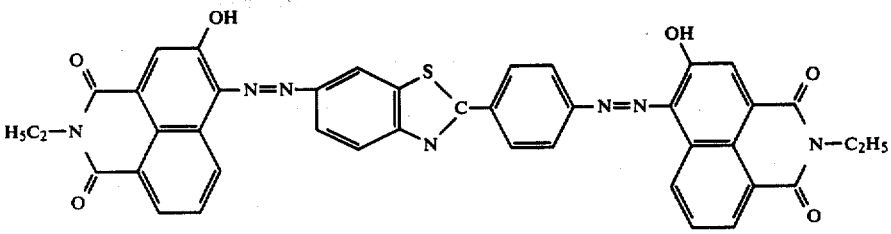
(26)
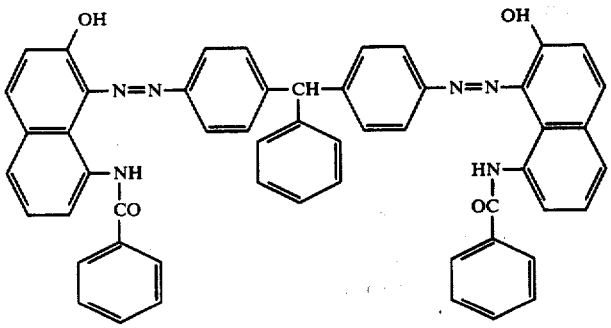

-continued

Charge generating materials

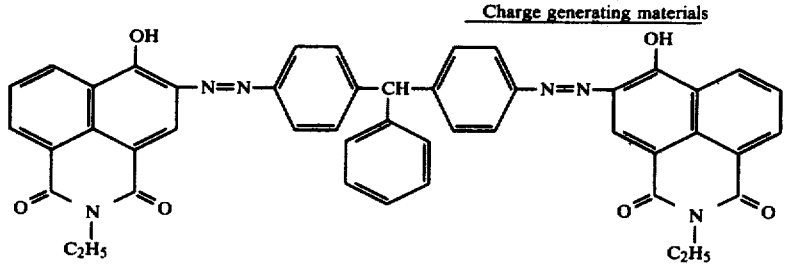

(27)

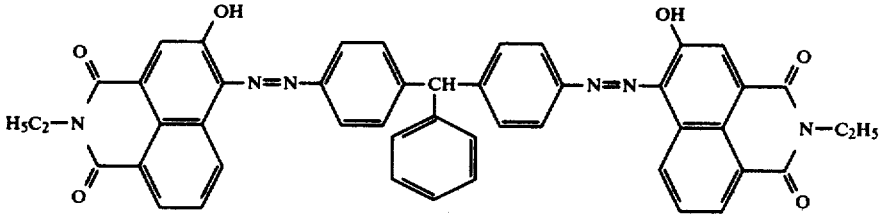

(28)

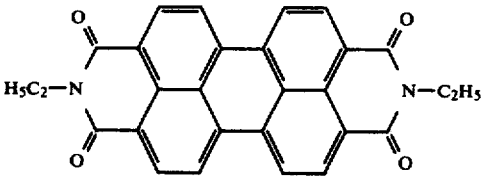

(29)

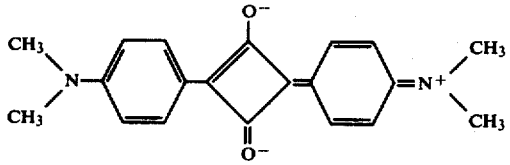

(30)

Copper phthalocyanine (31)

Cadmium sulfide (32)

The above-cited pigments can be used singly or in combination, and in any crystal form, $\alpha$, $\beta$, or others, of which the $\beta$-form is preferable.

The electrophotographic photosensitive member of this invention can be prepared by overlaying a suitable substrate with a charge generation layer containing the above-cited pigment and laminating a charge transport layer on this charge generation layer. This type of electrophotographic photosensitive member may also be provided with an intermediate layer between the substrate and the charge generation layer. This intermediate layer, when the photosensitive layers of laminate structure is charged, bars the injection of free charges from the conductive substrate into the photosensitive layers and acts at the same time as a bond layer to hold the photosensitive layers and the conductive layer en masse. The intermediate layer can be formed from a metal oxide such as aluminum oxide or a polymer such as polyethylene, polypropylene, acrylic resins, methacrylic resins, vinyl chloride resin, phenolic resins, epoxy resins, polyester resins, alkyd resins, polycarbonates, polyurethanes, polyimide resins, vinylidene chloride resin, vinyl chloride-vinyl acetate copolymer, casein, gelatin, poly(vinyl alcohol), ethyleneacrylic acid copolymer, nitrocellulose, and the like. Thickness of the intermediate or bond layer is 0.1 to 5$\mu$, preferably 0.5 to 3$\mu$. A laminate structure wherein the charge generation layer is laid on the upper side of the charge transport layer is also acceptable. In this case, a suitable protective top coat may be formed.

For dispersing the pigment, known means can be applied such as ball mills, attritors, and the like, where the pigment particle size is reduced to 5$\mu$ or less, preferably 2$\mu$ or less, and most preferably 0.5$\mu$ or less.

The pigment can also be applied after dissolved in an amine type of solvent such as ethylene diamine, and the like. The coating is carried out by a usual method such as blade coating, Meyer bar coating, spray coating, dip coating, and the like.

The charge generation layer surface can be mirror-finished, if necessary, for uniforming the carrier injection from the charge generation layer to the upper charge transport layer.

The charge transport layer is formed on the charge generation layer thus prepared. When the charge-transporting material has no film forming property, it is dissolved together with a binder in a suitable organic solvent and this coating solution is applied and dried in a usual way to form the charge transport layer.

Another embodiment of the electrophotographic photosensitive member of this invention comprises a conductive layer and a photosensitive layer formed thereon from a dispersion of said charge-generating material in a charge-transporting medium which comprises said pyrazoline compound as a charge-transporting material and an insulating binder [alternatively, said medium comprises a binder, such as poly(N-vinylcarbazole), which also functions as a charge-transporting material]. Insulating binders usable in this case include, for example, those disclosed in Japanese Patent Kokai Nos. 30328/1972 and 18545/1972 (corresponding to U.S. Pat. Nos. 3,894,868 and 3,870,516, respectively).

Substrates for use in the electrophotographic photosensitive member of this invention may be of any type existing so far as it is provided with conductivity. They include, for example, metallic sheets of aluminum, vanadium, molybdenum, chromium, cadmium, titanium, nickel, copper, zinc, palladium, indium, tin, platinum, gold, stainless steel, and brass and plastic sheets on which a metal is vacuum-deposited or a metal foil is laminated.

The electrophotographic photosensitive member of this invention is available not only for electrophotographic copying machines but also over wide fields of electrophotographic application such as those of laser printers, CRT printers, and electrophotographic printing plate making systems.

The electrophotographic photosensitive member according to this invention has outstandingly high sensitivity as compared with those employing conventional organic photoconductive materials and additionally it does not cause an increase in light area potential or a decrease in dark area potential even when its charging and exposure are repeated 10,000 times or more.

This invention will be illustrated referring to the following Examples:

EXAMPLES 1-9

A solution of defatted casein in an aqueous ammonia (casein 11.2 g, 28% aqueous ammonia 1 g, water 222 ml) was coated by means of a Meyer bar on an aluminum sheet and dried to form a bond layer of 1.0 g/m$^2$.

A dispersion of 5 g of a disazo pigment having the following structure in a solution of 2 g of a butyral resin (butyral conversion degree 63 mol%) in 95 ml of ethanol was prepared by mixing in a ball mill for 40 hours and was coated by means of a Meyer bar on said bond layer to form a charge generation layer of 0.2 g/m$^2$ after drying.

Disazo pigment (pigment No. 10 cited above)

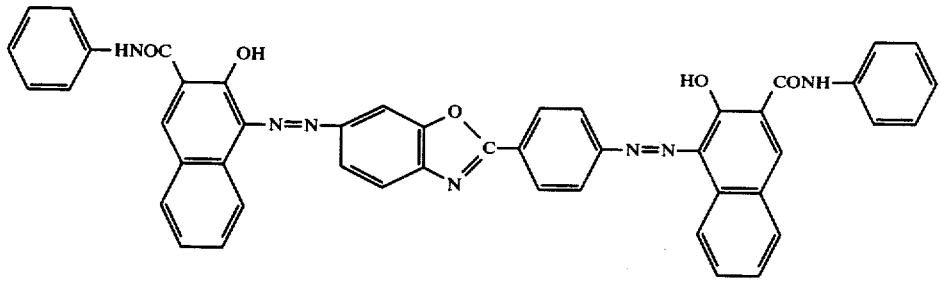

A solution prepared by dissolving 5 g of a pyrazoline compound shown in Table 1 and 5 g of a polycarbonate of bisphenol A (mol.wt. about 30,000) in 70 ml of tetrahydrofuran was coated on said charge generation layer and dried to form a charge transport layer of 10 g/m$^2$.

Electrophotographic photosensitive members containing different pyrazoline compounds, thus prepared were tested for charge bearing characteristics by the following methods. They were moisture-conditioned at 20° C. and 65% R.H., corona-charged at ⊖5 KV in the static fashion using an electrostatic copying paper testing machine (Model SP-428, mfd. by Kawaguchi Denki K.K.), and after 10-second standing at the dark, were exposed to light at an intensity of 5 lux.

Charge bearing characteristics of these photosensitive members thus examined are shown in Table 1, wherein Vo is initial potential (−volt) produced by the charging, $V_K$ is percentage retention of the potential after standing for 10 seconds at the dark, and E ½ is exposure quantity (lux.sec) for halving the initial potential.

TABLE 1

| Example No. | Pyrazoline | Vo (volt) | $V_K$ (%) | E ½ (lux.sec) |
|---|---|---|---|---|
| 1 | No. (2) | −620 | 92 | 3.8 |
| 2 | No. (62) | −680 | 92 | 3.2 |
| 3 | No. (166) | −650 | 91 | 4.6 |
| 4 | No. (285) | −620 | 93 | 5.6 |
| 5 | No. (371) | −640 | 92 | 4.8 |
| 6 | No. (416) | −620 | 92 | 4.1 |
| 7 | No. (503) | −620 | 90 | 6.8 |
| 8 | No. (523) | −600 | 90 | 8.6 |
| 9 | No. (531) | −670 | 93 | 3.0 |

Photosensitive members of these Examples each were attached onto a cylindrical drum, which was then set in a copying machine, wherein the drum is surrounded by a negative-charging device, light-irradiation optical system, development device, and charging device for transfer copying, so that image forming operations proceed successively as the drum revolves, to give images on sheets of transfer paper.

The photosensitive members of these Examples gave clear images at a light area exposure quantity of 15 lux.sec, and the images were good even when 25,000 or more copies were produced therewith.

EXAMPLES 10-169

Electrophotographic photosensitive members were prepared and tested for charge bearing characteristics, in the same manner as in Example 1 except for using pyrazoline compounds shown in Table 2 as charge-transporting materials in place of pyrazoline compound No. 2. The results are shown in Table 2.

TABLE 2

| Example No. | Pyrazoline | Vo (volt) | $V_K$ (%) | E ½ (lux.sec) |
|---|---|---|---|---|
| 10 | No. (35) | −640 | 92 | 3.2 |
| 11 | No. (3) | −610 | 92 | 6.7 |
| 12 | No. (6) | −600 | 93 | 6.1 |
| 13 | No. (7) | −550 | 90 | 4.8 |
| 14 | No. (8) | −560 | 92 | 5.0 |
| 15 | No. (9) | −520 | 90 | 7.0 |
| 16 | No. (15) | −630 | 92 | 3.1 |
| 17 | No. (21) | −520 | 92 | 7.3 |
| 18 | No. (23) | −580 | 90 | 6.5 |

TABLE 2-continued

| Example No. | Pyrazoline | Vo (volt) | $V_K$ (%) | E ½ (lux.sec) |
|---|---|---|---|---|
| 19 | No. (24) | −570 | 92 | 5.8 |
| 20 | No. (25) | −550 | 91 | 6.2 |
| 21 | No. (27) | −670 | 93 | 3.0 |
| 22 | No. (31) | −580 | 92 | 6.3 |
| 23 | No. (39) | −550 | 90 | 6.5 |
| 24 | No. (42) | −520 | 90 | 6.7 |
| 25 | No. (48) | −650 | 93 | 3.0 |
| 26 | No. (49) | −600 | 90 | 4.4 |
| 27 | No. (52) | −550 | 90 | 6.1 |
| 28 | No. (55) | −520 | 91 | 6.7 |
| 29 | No. (63) | −600 | 90 | 6.6 |
| 30 | No. (66) | −640 | 92 | 4.1 |
| 31 | No. (67) | −630 | 91 | 3.8 |
| 32 | No. (68) | −650 | 93 | 4.0 |
| 33 | No. (69) | −580 | 90 | 6.1 |
| 34 | No. (73) | −550 | 92 | 6.7 |
| 35 | No. (77) | −680 | 90 | 3.0 |
| 36 | No. (78) | −620 | 92 | 4.7 |
| 37 | No. (81) | −640 | 90 | 3.2 |
| 38 | No. (92) | −630 | 92 | 3.0 |
| 39 | No. (96) | −650 | 92 | 4.0 |
| 40 | No. (97) | −610 | 90 | 5.2 |
| 41 | No. (98) | −600 | 92 | 6.3 |
| 42 | No. (107) | −670 | 92 | 3.0 |
| 43 | No. (113) | −680 | 92 | 3.0 |
| 44 | No. (114) | −610 | 93 | 6.4 |
| 45 | No. (117) | −660 | 92 | 4.2 |
| 46 | No. (124) | −670 | 90 | 3.8 |
| 47 | No. (125) | −600 | 92 | 6.2 |
| 48 | No. (128) | −640 | 90 | 4.2 |
| 49 | No. (135) | −650 | 92 | 3.7 |
| 50 | No. (139) | −620 | 90 | 4.9 |
| 51 | No. (146) | −670 | 92 | 3.1 |
| 52 | No. (150) | −620 | 90 | 4.7 |
| 53 | No. (151) | −610 | 92 | 6.6 |
| 54 | No. (152) | −600 | 90 | 6.5 |
| 55 | No. (167) | −600 | 90 | 5.2 |
| 56 | No. (172) | −620 | 91 | 5.0 |
| 57 | No. (173) | −610 | 92 | 4.8 |
| 58 | No. (174) | −610 | 90 | 4.6 |
| 59 | No. (175) | −600 | 92 | 5.2 |
| 60 | No. (178) | −580 | 90 | 6.2 |
| 61 | No. (180) | −590 | 91 | 4.7 |
| 62 | No. (191) | −650 | 92 | 3.2 |
| 63 | No. (195) | −660 | 91 | 3.3 |
| 64 | No. (196) | −600 | 90 | 4.9 |
| 65 | No. (208) | −580 | 91 | 5.7 |
| 66 | No. (217) | −610 | 92 | 5.2 |
| 67 | No. (224) | −640 | 92 | 3.4 |
| 68 | No. (231) | −590 | 90 | 6.6 |
| 69 | No. (232) | −580 | 90 | 5.2 |
| 70 | No. (235) | −570 | 90 | 6.0 |
| 71 | No. (236) | −580 | 92 | 6.1 |
| 72 | No. (237) | −560 | 90 | 6.8 |
| 73 | No. (238) | −570 | 90 | 7.1 |
| 74 | No. (239) | −570 | 91 | 6.8 |
| 75 | No. (254) | −650 | 90 | 3.1 |
| 76 | No. (255) | −600 | 90 | 4.6 |
| 77 | No. (266) | −580 | 92 | 5.9 |
| 78 | No. (271) | −570 | 90 | 6.3 |
| 79 | No. (273) | −600 | 91 | 4.7 |
| 80 | No. (286) | −610 | 92 | 5.2 |
| 81 | No. (274) | −580 | 90 | 7.6 |
| 82 | No. (289) | −610 | 92 | 4.1 |
| 83 | No. (290) | −620 | 90 | 4.0 |
| 84 | No. (292) | −620 | 92 | 3.6 |
| 85 | No. (295) | −570 | 90 | 8.2 |
| 86 | No. (297) | −600 | 92 | 6.1 |
| 87 | No. (301) | −560 | 90 | 8.3 |
| 88 | No. (305) | −650 | 90 | 3.1 |
| 89 | No. (310) | −630 | 92 | 4.5 |
| 90 | No. (312) | −620 | 90 | 6.3 |
| 91 | No. (317) | −620 | 93 | 5.4 |
| 92 | No. (325) | −640 | 90 | 4.7 |
| 93 | No. (337) | −600 | 90 | 6.6 |
| 94 | No. (344) | −620 | 92 | 7.3 |
| 95 | No. (345) | −650 | 90 | 3.7 |
| 96 | No. (349) | −600 | 90 | 7.0 |
| 97 | No. (352) | −580 | 92 | 7.6 |
| 98 | No. (358) | −570 | 90 | 8.2 |

TABLE 2-continued

| Example No. | Pyrazoline | Vo (volt) | $V_K$ (%) | E ½ (lux.sec) |
|---|---|---|---|---|
| 99 | No. (363) | −550 | 92 | 8.7 |
| 100 | No. (366) | −630 | 93 | 4.2 |
| 101 | No. (367) | −650 | 91 | 5.1 |
| 102 | No. (372) | −620 | 92 | 5.8 |
| 103 | No. (373) | −580 | 90 | 7.6 |
| 104 | No. (374) | −630 | 91 | 3.6 |
| 105 | No. (378) | −650 | 90 | 4.1 |
| 106 | No. (383) | −630 | 90 | 7.8 |
| 107 | No. (386) | −600 | 92 | 6.9 |
| 108 | No. (395) | −620 | 90 | 6.0 |
| 109 | No. (400) | −640 | 92 | 4.3 |
| 110 | No. (402) | −600 | 90 | 5.6 |
| 111 | No. (407) | −620 | 92 | 3.2 |
| 112 | No. (411) | −630 | 93 | 4.0 |
| 113 | No. (417) | −580 | 90 | 7.9 |
| 114 | No. (422) | −600 | 92 | 6.5 |
| 115 | No. (424) | −610 | 91 | 4.2 |
| 116 | No. (425) | −590 | 93 | 5.6 |
| 117 | No. (427) | −610 | 90 | 5.8 |
| 118 | No. (428) | −550 | 90 | 8.0 |
| 119 | No. (437) | −610 | 92 | 4.0 |
| 120 | No. (442) | −600 | 90 | 5.9 |
| 121 | No. (448) | −570 | 90 | 7.8 |
| 122 | No. (449) | −560 | 91 | 8.2 |
| 123 | No. (458) | −620 | 93 | 3.8 |
| 124 | No. (459) | −570 | 90 | 7.6 |
| 125 | No. (464) | −580 | 91 | 8.3 |
| 126 | No. (471) | −570 | 92 | 7.9 |
| 127 | No. (477) | −550 | 90 | 8.4 |
| 128 | No. (479) | −640 | 90 | 4.1 |
| 129 | No. (484) | −600 | 92 | 4.9 |
| 130 | No. (487) | −570 | 90 | 7.7 |
| 131 | No. (490) | −560 | 91 | 8.3 |
| 132 | No. (491) | −550 | 90 | 8.5 |
| 133 | No. (492) | −560 | 90 | 7.8 |
| 134 | No. (497) | −550 | 90 | 8.6 |
| 135 | No. (501) | −620 | 92 | 4.3 |
| 136 | No. (504) | −600 | 92 | 8.2 |
| 137 | No. (505) | −630 | 90 | 5.5 |
| 138 | No. (506) | −660 | 92 | 3.2 |
| 139 | No. (507) | −650 | 91 | 4.6 |
| 140 | No. (508) | −620 | 92 | 6.6 |
| 141 | No. (509) | −660 | 92 | 3.2 |
| 142 | No. (511) | −650 | 90 | 5.2 |
| 143 | No. (512) | −600 | 90 | 8.9 |
| 144 | No. (514) | −620 | 91 | 7.8 |
| 145 | No. (516) | −650 | 90 | 6.8 |
| 146 | No. (519) | −600 | 90 | 10.2 |
| 147 | No. (524) | −610 | 90 | 9.3 |
| 148 | No. (525) | −630 | 90 | 6.4 |
| 149 | No. (526) | −620 | 91 | 5.1 |
| 150 | No. (527) | −640 | 90 | 5.5 |
| 151 | No. (528) | −590 | 89 | 8.8 |
| 152 | No. (529) | −620 | 91 | 4.7 |
| 153 | No. (530) | −600 | 90 | 7.8 |
| 154 | No. (533) | −600 | 92 | 7.6 |
| 155 | No. (534) | −610 | 90 | 8.7 |
| 156 | No. (535) | −620 | 93 | 7.9 |
| 157 | No. (536) | −620 | 91 | 12.6 |
| 158 | No. (539) | −600 | 90 | 6.7 |
| 159 | No. (541) | −630 | 92 | 5.1 |
| 160 | No. (543) | −650 | 92 | 3.8 |
| 161 | No. (546) | −580 | 91 | 7.8 |
| 162 | No. (547) | −570 | 90 | 8.3 |
| 163 | No. (549) | −690 | 92 | 3.2 |
| 164 | No. (550) | −590 | 91 | 8.0 |
| 165 | No. (557) | −630 | 92 | 4.2 |
| 166 | No. (558) | −670 | 93 | 3.3 |
| 167 | No. (561) | −680 | 93 | 3.0 |
| 168 | No. (563) | −600 | 92 | 8.8 |
| 169 | No. (567) | −640 | 91 | 4.7 |

The photosensitive members of these Examples were also set in the copying machine used in Example 1 and images were formed therewith, with the result that clear images showing no fogging were obtained, and in addition the images were good even when 25,000 or more copies were produced therewith.

EXAMPLES 170–178

A charge generation layer 0.15μ thick was formed on an aluminum plate 100μ thick by vacuum deposition of perylene pigment of the following structure.

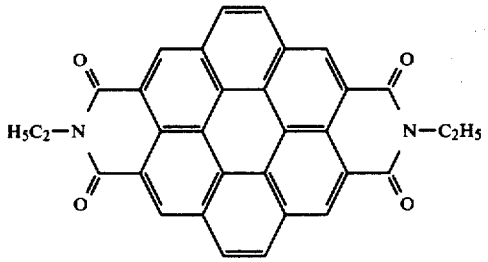

A solution prepared by dissolving 5 g of a polyester resin (Vylon 200, mfd. by Toyo Spinning Co., Ltd.) and 5 g of a pyrazoline compound shown in Table 3 in 150 ml of dichloromethane was coated on said charge generation layer and dried to form a charge transport layer of 11 g/m$^2$.

Electrophotographic photosensitive members containing different pyrazoline compounds, thus prespared were tested for charge bearing characteristics in the same fashion as in Example 1. The results are shown in Table 3.

TABLE 3

| Example No. | Pyrazoline | Vo (volt) | $V_K$ (%) | E ½ (lux.sec) |
|---|---|---|---|---|
| 170 | No. (2) | −630 | 93 | 10.6 |
| 171 | No. (62) | −660 | 93 | 4.2 |
| 172 | No. (166) | −640 | 93 | 4.7 |
| 173 | No. (285) | −610 | 93 | 4.7 |
| 174 | No. (371) | −580 | 93 | 8.6 |
| 175 | No. (416) | −600 | 93 | 7.9 |
| 176 | No. (503) | −580 | 92 | 10.9 |
| 177 | No. (523) | −560 | 92 | 12.2 |
| 178 | No. (531) | −620 | 93 | 7.9 |

These photosensitive members were also tested for durability in the same manner as in Example 1, giving good images up to 25,000 or more copies.

EXAMPLES 179–187

Electrophotographic photosensitive members were prepared and tested, in the same manner as in Examples 1–9 except for using a disazo pigment of the following structure as a charge-generating material in place of the disazo pigments used in Examples 1–9.

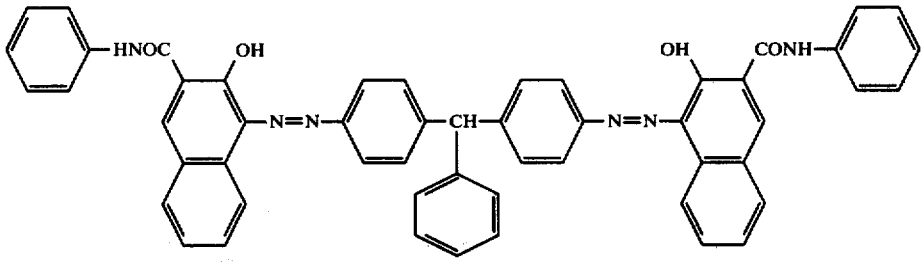

Charge bearing characteristics of these photosensitive members, measured in the same fashion as used in Examples 1–9 are shown in Table 4.

TABLE 4

| Example No. | Pyrazoline | Vo (volt) | $V_K$ (%) | E ½ (lux.sec) |
|---|---|---|---|---|
| 179 | No. (2) | −640 | 93 | 8.9 |
| 180 | No. (62) | −680 | 93 | 6.2 |
| 181 | No. (166) | −570 | 90 | 6.7 |
| 182 | No. (285) | −600 | 93 | 6.6 |
| 183 | No. (371) | −600 | 90 | 7.6 |
| 184 | No. (416) | −600 | 90 | 4.7 |
| 185 | No. (503) | −680 | 93 | 9.8 |
| 186 | No. (523) | −600 | 92 | 7.8 |
| 187 | No. (531) | −660 | 90 | 6.0 |

These photosensitive members were also tested for durability in the same manner as in Example 1, giving good images up to 25,000 or more copies.

EXAMPLES 188–196

A mixture of 20 g of a poly(N-vinylcarbazole), (mol. wt. about 300,000), 3.0 g of a pyrazoline compound shown in Table 5, 10 g of a polyester resin solution (solid content 20%, registered trade mark: Polyester Adhesive 490,000, mfd. by DuPont de Nemours & Co.), 2.0 g of a pigment of the following structure, and 180 ml of tetrahydrofuran were dispersed in a ball mill for 40 hours. The resulting dispersion was coated by means of an applicator on an aluminum coating vacuum-deposited on a Mylar film and dried to give a coating weight of 12 g/m$^2$.

Electrophotographic photosensitive members prepared in this way were tested for charge bearing characteristics in the same fashion as described in Example 1 but the charging polarity was positive. The results are shown in Table 5.

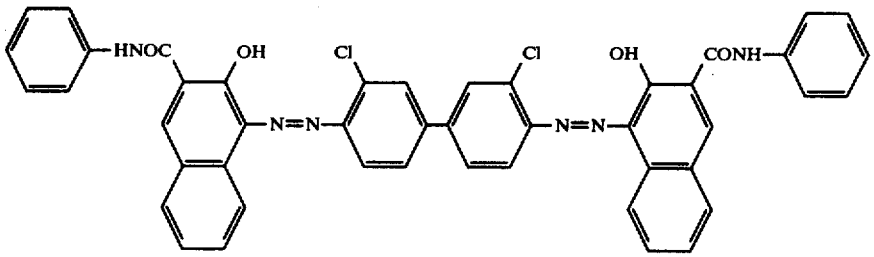

TABLE 5

| Example No. | Pyrazoline | Vo (volt) | $V_K$ (%) | E ½ (lux.sec) |
|---|---|---|---|---|
| 188 | No. (27) | +440 | 82 | 12.9 |
| 189 | No. (113) | +470 | 84 | 13.8 |
| 190 | No. (275) | +490 | 86 | 14.2 |
| 191 | No. (345) | +460 | 89 | 12.6 |
| 192 | No. (407) | +450 | 84 | 18.6 |
| 193 | No. (501) | +450 | 83 | 16.6 |
| 194 | No. (503) | +470 | 88 | 14.6 |
| 195 | No. (523) | +480 | 90 | 15.2 |
| 196 | No. (544) | +460 | 86 | 15.7 |

EXAMPLES 197-205

A surface-cleaned molybdenum plate (substrate) 0.2 mm thick was fixed on a predetermined position of a glow discharge vacuum-deposition chamber. After the chamber was evacuated to about $5\times10^{-6}$ torr, the input voltage of a heater was raised and the molybdenum substrate temperature was settled to 150° C. Hydrogen gas and silane gas (15 vol.% based on hydrogen gas) were introduced into the chamber and the chamber pressure was settled to 0.5 torr by regulating the gas flow rates and a main valve of the chamber.

Then, 5 MHz high frequency power was applied to an induction coil to generate a glow discharge in an internal space, surrounded by the coil, of the chamber, where the input power was 30 W. Under these conditions, amorphous silicon film was grown to a thickness of 2μ, and thereafter the glow discharge was stopped. The heater and the high frequency power source were turned off, and after the substrate temperature dropped to 100° C., the hydrogen inlet valve and the silane inlet valve were turned off to evacuate the chamber to $10^{-5}$ torr or less, then the chamber pressure was returned to the atmospheric value, and the substrate was taken out.

The same charge transport layer as each of Examples 1-9 was formed in the same manner as in Example 1 on each of amorphous silicon layers prepared by the above-mentioned procedure.

Photosensitive members thus obtained were set each in a charging and exposing testing machine, corona-charged at ⊖6 KV, and immediately thereafter was irradiated with a pattern of light which was projected by using a tungsten lamp through a transmission type of test chart.

Immediately thereafter, the members were cascaded by a positive-working developer (containing toner and carrier) to obtain good images on the surfaces of the photosensitive members.

What we claim is:

1. An electrophotographic photosensitive member comprising a charge generation layer and a charge transport layer which includes at least one pyrazoline compound represented by the following formula:

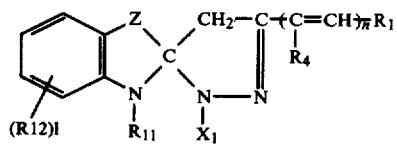

wherein $X_1$ is a substituted or unsubstituted heterocyclic residue selected from the group consisting of substituted or unsubstituted pyridyl, quinolyl, carbazolyl, furyl, imidazolyl, oxazolyl, and isoxazolyl;

$R_1$ is a substituted or unsubstituted aryl or heterocyclic residue;

$R_4$ is hydrogen, a halogen, or a substituted or unsubstituted alkyl or aryl;

$R_{11}$ is a substituted or unsubstituted alkyl;

$R_{12}$ is hydrogen, a halogen, or an organic monovalent residue;

Z is

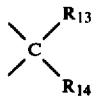

or —CH=CH—, wherein $R_{13}$ and $R_{14}$ are each a substituted or unsubstituted alkyl;

n is 0 or 1; and l is an integer of 1 to 4.

2. An electrophotographic photosensitive member of claim 1, wherein said $R_1$ is a di-substituted aminophenyl.

3. An electrophotographic photosensitive member of claim 2, wherein said di-substituted aminophenyl is a dialkylaminophenyl.

4. An electrophotographic photosensitive member of claim 3, wherein said dialkylaminophenyl is selected from the group consisting of dimethylaminophenyl, diethylaminophenyl, dipropylaminophenyl, dibutylaminophenyl, and dibenzylaminophenyl.

5. An electrophotographic photosensitive member of claim 4, wherein said dialkylamino is diethylaminophenyl.

6. An electrophotographic photosensitive member of claim 1, wherein said $R_1$ is a heterocyclic residue selected from the group consisting of pyridyl, quinolyl, carbazolyl, and imidazolyl.

7. An electrophotographic photosensitive member of claim 6, wherein said $R_1$ is carbazolyl.

8. An electrophotographic photosensitive member of claim 1, wherein said $X_1$ is a heterocyclic residue selected from the group consisting of 2-pyridyl, 3-pyridyl, 4-pyridyl, 6-methoxy-2-pyridyl, 2-quinolyl, 4-quinolyl, 2-lepidyl, 3-carbazolyl, and 9-ethyl-3-carbazolyl.

9. An electrophotographic photosensitive member comprising a layer which includes a charge generating material, a binder and at least one pyrazoline compound of the formula:

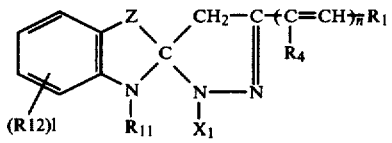

wherein $X_1$ is a substituted or unsubstituted heterocyclic residue selected from the group consisting of substituted or unsubstituted pyridyl, quinolyl, carbazolyl, furyl, imidazolyl, oxazolyl and isoxazolyl;

$R_1$ is a substituted or unsubstituted aryl or heterocyclic residue;

$R_4$ is hydrogen, a halogen, or a substituted or unsubstituted alkyl or aryl;

$R_{11}$ is a substituted or unsubstituted alkyl;

$R_{12}$ is hydrogen, a halogen or an organic monovalent residue;

Z is

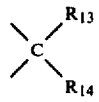

or —CH=CH—, wherein $R_{13}$ and $R_{14}$ are each substituted or unsubstituted alkyl;

n is 0 or 1; and l is an integer of 1 to 4.

* * * * *